US011383801B2

(12) United States Patent
Magnusson et al.

(10) Patent No.: US 11,383,801 B2
(45) Date of Patent: Jul. 12, 2022

(54) MOORING DEVICE AND A FLOATING UNIT COMPRISING AT LEAST ONE MOORING DEVICE

(71) Applicant: Connect LNG AS, Oslo (NO)

(72) Inventors: Stian Tunestveit Magnusson, Oslo (NO); David Mikal Knutsen, Oslo (NO)

(73) Assignee: Connect LNG AS, Oslo (NO)

( * ) Notice: Subject to any disclaimer, the term of this patent is extended or adjusted under 35 U.S.C. 154(b) by 49 days.

(21) Appl. No.: 16/968,891

(22) PCT Filed: Feb. 15, 2019

(86) PCT No.: PCT/EP2019/053855
§ 371 (c)(1),
(2) Date: Aug. 11, 2020

(87) PCT Pub. No.: WO2019/158710
PCT Pub. Date: Aug. 22, 2019

(65) Prior Publication Data

US 2021/0047013 A1 Feb. 18, 2021

(30) Foreign Application Priority Data

Feb. 19, 2018 (NO) ..... 20180263
Dec. 19, 2018 (NO) ..... 20181650

(51) Int. Cl.
*B63B 59/02* (2006.01)
*B63B 35/44* (2006.01)
*B63B 21/00* (2006.01)

(52) U.S. Cl.
CPC ..... *B63B 59/02* (2013.01); *B63B 35/4413* (2013.01); *B63B 2021/001* (2013.01); *B63B 2059/025* (2013.01)

(58) Field of Classification Search
CPC ..... B63B 21/00; B63B 2021/001; B63B 2021/003; B63B 35/4413; B63B 59/02; B63B 2059/025
(Continued)

(56) References Cited

U.S. PATENT DOCUMENTS 3,142,284 A 7/1964 Kaufman
3,463,114 A 8/1969 Lovell
(Continued)

FOREIGN PATENT DOCUMENTS

CN 85109429 7/1986
CN 101035708 9/2007
(Continued)

OTHER PUBLICATIONS

Search Report dated Jan. 13, 2022 from China patent office, cited inter alia as statement of relevan ce for any non-English refs cited therein. All refs designated "A" (background art).

*Primary Examiner* — Daniel V Venne
(74) *Attorney, Agent, or Firm* — Christian D. Abel

(57) ABSTRACT

There is disclosed a mooring device (10) comprising an attachment unit (66) for mooring of a floating unit (110) to a floating or non-floating structure (125). The mooring device (10) comprises a first mooring arm (12) and a second mooring arm (20) for transferring and/or absorbing forces and energy that arises when the floating unit (110) moves relative to the floating or non-floating structure. There is also disclosed a floating unit and a floating or non-floating structure comprising one or more such mooring devices (10).

28 Claims, 20 Drawing Sheets

(58) Field of Classification Search
USPC ..... 114/219, 230.1, 230.15
See application file for complete search history.

(56) References Cited

U.S. PATENT DOCUMENTS

| | | | | |
|---|---|---|---|---|
| 4,193,368 | A | 3/1980 | DeGraaf et al. | |
| 5,575,234 | A | 11/1996 | Dysarz | |
| 6,938,570 | B2 * | 9/2005 | Montgomery | E02B 3/24 114/230.1 |
| 8,499,709 | B2 * | 8/2013 | Lee | B63B 21/00 114/230.19 |

FOREIGN PATENT DOCUMENTS

| | | |
|---|---|---|
| CN | 101356092 | 1/2009 |
| EP | 2500256 | 9/2012 |
| GB | 2040849 | 9/1980 |
| WO | 2003/033341 | 4/2003 |
| WO | 2015/107147 | 7/2015 |
| WO | 20140063 | 7/2015 |

* cited by examiner

Section A-A

MOORING DEVICE AND A FLOATING UNIT COMPRISING AT LEAST ONE MOORING DEVICE

The present invention is related to a mooring device for mooring of a floating unit to a floating or non-floating structure and a floating unit and a non-floating structure comprising one or more such mooring devices.

Floating units of various types such as semi-submersible units, ships, barges and other types of floating unit, for various reasons, at times usually need to be moored to a floating structure, such as a semi-submersible unit, a ship, a barge or other types of floating vessels, or to a non-floating structure, such as a quay, a pier or similar non-floating structure that the floating unit can be moored to.

Transfer of temperate fluids from ship to shore is today achieved, among other methods, through a submerged flexible hose, which is lifted from the seabed and connected directly to the vessel manifold.

The handling of pipes for cryogenic applications will, however, often be difficult for the ship's lifting equipment and manifold since the transfer of cryogenic fluids through the pipes will cause accumulation of an external ice layer. The transfer of cryogenic liquids through any pipe in contact with water therefore requires the pipe to be extensively insulated, resulting in considerably larger weight per meter than pipes for transfer of temperate fluids. The insulation is also required to avoid excessive heat loss.

The use of loading systems comprising various types of floating concepts are known in the offshore petroleum industry. Environmental conditions offshore are often harsh, which significantly increases the requirements and cost for systems to operate in these conditions.

A few mooring devices, other than traditional ropes, wires or the like, are known in the art. For example, to overcome at least some of the problems of the prior art, a floating unit for transfer of a fluid or electric power between a floating structure and a floating or non-floating structure has been proposed and described in the publication WO 2015/107147 A1. There is, however, a need for further improvement of the mooring system that is disclosed in this publication that can be used to moor a floating unit to a floating or non-floating structure.

Other known mooring systems are disclosed in the publications US 2004/154518 A1 and WO 2009/048342 A2.

An objective of the present invention has therefore been to provide a mooring device for mooring a floating unit to a floating or non-floating structure that allows vertical translational motion and rotational motion about any horizontal axis of the floating unit relative to the floating or non-floating structure while lateral translational motion and rotational motion about a vertical axis of the floating unit relative to the floating or non-floating structure is substantially restricted.

Another objective of the present invention has been to optimize the transfer of loads through the mooring device where the loads are caused by relative motions between a floating unit and a floating or non-floating structure when the floating unit is moored to the floating or non-floating structure with one or more mooring devices according to the present invention.

Another objective has been to make it possible to obtain a close mooring distance between a floating unit and a floating or non-floating structure also when there is a large freeboard difference between the floating unit and the floating or non-floating unit.

Another objective has been to obtain a mooring device that provides a robust and reliable connection between the floating unit and the floating or non-floating structure to which the floating unit is moored.

Another objective has been to obtain a mooring device with low manufacturing and installation costs and low maintenance costs.

These objectives are achieved by a mooring frame as defined in claim 1, a floating structure as defined in claim 21, a non-floating structure as defined in claim 22, and use of the mooring frame as defined in claims 29 and 30. The independent claims define further embodiments of mooring frame and the floating structure.

The mooring device disclosed herein can be used to temporarily moor a floating unit, such as a vessel or a platform, to another floating or non-floating unit, vessel or structure. The mooring device absorbs forces and energy that arise from relative motions between the floating unit and the floating or non-floating structure. The forces and energy that arises from relative motions taking place in two main directions in a horizontal plane, a first direction and a second direction, which are typically the x-direction and y-direction in a Cartesian coordinate system, are absorbed by the mooring device.

Typically, two mooring devices may be used to moor the floating unit which are connected to the floating unit or to the floating or non-floating unit, vessel or structure with a joint that allows rotational motion about three independent axes, for example universal joints. The frames are provided with vacuum pads or electromagnetic pads for temporary mooring of the floating unit to the floating or non-floating unit or vessel and thereby transferring loads that arise from the relative motion. The mooring devices may be provided with mooring units and support elements that absorb energy from relative translational motion in the horizontal plane by using integrated stiffness elements, for example spring elements. Damping elements may also be included if that is required.

There is disclosed a mooring device for mooring of a floating unit to a structure where the structure is floating or non-floating. The mooring device is adapted to be mounted on the structure and the mooring device comprises:

- a first mooring arm for transferring and/or absorbing forces and energy that arises when the floating unit is moored to the structure and the floating unit moves relative to the structure, the first mooring arm having a longitudinal axis,
- a second mooring arm for transferring and/or absorbing forces and energy that arises when the floating unit is moored to the structure and the floating unit moves relative to the structure, the second mooring arm having a longitudinal axis,
- a joint device comprising a support element, a support element joint device and an attachment unit joint device, the support element joint device being connected to the support element and the attachment unit joint device being attached to or connected to the support element,
- an attachment unit that is attached to the attachment unit joint device, the attachment unit joint device allowing rotation of the attachment unit about two or three independent axes of rotation relative to the support element, wherein
- the support element joint device comprises a first mooring arm joint device connected to or attached to the support element and a second mooring arm joint member connected to or attached to the support element, the first mooring arm comprises a first end portion and a second end portion, the second end portion being adapted for attachment to the floating unit or the structure, and the first end portion being attached to the first mooring arm joint device, the second mooring arm comprises a first end portion and a second end portion, the second end portion being adapted for attachment to the floating unit or the structure, and the first end portion being attached to the second mooring arm joint device, the support element joint device allows rotation of the support element about one rotational axis A only, relative to the first mooring arm and/or the second mooring arm in all positions of the axis A, the rotational axis A being perpendicular to a plane that is formed by the longitudinal axis of the first mooring arm and the longitudinal axis of the second mooring arm in all positions of the first mooring arm and the second mooring arm.

The second mooring arm joint device may allow rotation of the second mooring arm about zero, one or two or three independent axes of rotation relative to the support element.

The first mooring arm joint device may allow rotation of the first mooring arm about one or two or three independent axes of rotation relative to the support element.

The first mooring arm is telescopic and comprises first telescopic part comprising the first end portion of the first mooring arm, and a second telescopic part comprising the second end portion of the first mooring arm.

The second mooring arm is preferably telescopic and comprises first telescopic part comprising the first end portion of the second mooring arm, and a second telescopic part with the second end portion of the second mooring arm.

The first mooring arm may comprise a first double-acting, hydraulic cylinder and that the second arm comprises a second double-acting, hydraulic cylinder.

The first double-acting hydraulic cylinder and the second double-acting hydraulic cylinder are preferably passive hydraulic cylinders.

The first mooring arm joint device of the support element joint device or the second mooring arm joint device of the support element joint device is preferably securely attached to the support element.

The support element preferably comprises a base plate element, a first side plate element that is securely attached to the base plate element and a second side plate element that is securely attached to the base plate element, the first mooring arm and the second mooring arm being rotatably connected to the first side plate element and the second side plate element.

The support element joint device further preferably comprises a bolt element that goes through the first mooring arm joint device, the second mooring arm joint device, the first side plate element and the second side plate element such that the first mooring arm and the second mooring arm are rotatably connected to the support element about a longitudinal axis A of the bolt element.

In an embodiment, the first mooring arm joint device may be fork-shaped, the second mooring arm joint device is plate-shaped and adapted to fit into the fork-shaped first mooring arm joint device, the support element may be fork-shaped and the fork-shaped first mooring arm joint device may be adapted to fit into the fork-shaped support element, such that the bolt element goes through the first mooring arm joint device, the second mooring arm joint device, the first side plate element and the second side plate element.

The fork-shaped first mooring arm joint device may be securely attached to the support element, i.e. the first side plate element and/or the second side plate element.

The second end portion of the first mooring arm may be attached to a first attachment joint device that is adapted for attachment to the floating unit or the structure and allows rotation of the first mooring arm about three independent axes relative to the floating unit or the structure.

The second end portion of the second mooring arm may be attached to a second attachment joint device that is adapted for attachment to the floating unit or the structure and allows rotation of the second mooring arm about three independent axes relative to the floating unit or the structure.

This arrangement allows each of the first and second mooring arms to rotate about two different axes—about the axis A that is perpendicular to the plane formed by the longitudinal axes of the first and second mooring arms as defined above and about a second axis that passes through the first and second attachment joint devices respectively. When the arms are moving sideways, i.e. the first and second mooring arms move in a plane that is perpendicular to axis A, the axis A will be parallel to the rotational axes passing through the first and second attachment joint devices.

In an embodiment, the support element may comprise a plate element to which the first mooring arm joint device and the second mooring arm joint device are securely attached, the first mooring arm joint device and the second mooring arm joint device allowing rotation of the first mooring arm and the second mooring arm respectively about three independent axes of rotation.

The first mooring arm joint device and the second mooring arm joint device are preferably ball joints and/or universal joints.

The support element joint device preferably further comprises a restricting arm comprising a first end portion and a second end portion, the second end portion being adapted for attachment to the floating unit or the structure, and the first end portion being securely attached to the support element.

The restricting arm is preferably telescopic comprising a first telescopic part comprising the first end portion of the restricting arm, and a second telescopic part comprising the second end portion of the restricting arm.

The second end portion of the restricting arm is attached to an attachment joint device that is adapted for attachment to the floating unit or the structure and allows rotation of the restricting arm about two independent axes relative to the floating unit or the structure. The attachment joint device may for example be a cardan joint.

The restricting arm may be provided with a polygonally shaped cross-section such that rotation of the support element about a longitudinal axis of the restricting arm is prevented.

The first end portion of the restricting arm may be securely attached to the support element by welding or with at least one bolt element.

In an embodiment, the support element may comprise a holder element, a first pin element that is securely attached to the holder element and a second pin element that is securely attached to the holder element, the first mooring arm and the second mooring arm being rotatably connected to the first pin element and the second pin element respectively about an axis A that passes through the first pin element and the second pin element.

The fork-shaped first mooring arm joint device may be securely attached to the support element, for example to the holder element of the support element and/or to the first and/or second pin element of the support element. Alternatively, the fork-shaped second mooring arm joint device may be securely attached to the support element, for example to the holder element of the support element and/or to the first and/or second pin element of the support element.

The first mooring arm joint device may be fork-shaped and adapted to be rotatably connected to the first pin element and the second pin element of the holder element, and the second mooring arm joint device may be fork-shaped and adapted to be rotatably connected to the first pin element and the second pin element of the holder element.

The first pin element may be attached to a first side face of the holder element and the second pin element may be attached to a first side face of the holder element, where the first side face and the second side face are opposite exterior sides of the holder element.

The mooring device further may comprise a support arm comprising a first end portion to which a first attachment joint device is attached that is attached to the support element, and a second end portion to which a second attachment joint device is attached that is adapted for attachment to the floating unit or the structure, the first attachment joint device allowing rotation of the support arm about three independent axes relative to the support element and the second attachment joint device allowing rotation of the support arm about three independent axes relative to the floating unit or the structure.

Instead of one support arm for every mooring device, a support arm for every mooring arm may also be used.

The support arm is preferably telescopic and comprises a first telescopic part comprising the first end portion of the support arm and a second telescopic part comprising the second end portion of the support arm.

The attachment unit joint device may comprise a ball element that is securely attached to the support element and a ball support element that is securely attached to the attachment unit.

The attachment unit joint device may comprise a ball element that is securely attached to the attachment unit and a ball support element that is securely attached to the support element of the joint device.

The attachment unit preferably comprises a frame device to which at least one attachment member is rotatably attached and to which the attachment unit joint device is attached.

The at least one attachment member preferably comprises a vacuum pad or an electromagnetic pad.

A floating unit is also provided comprising at least one mooring device as described above, wherein the at least one mooring device is attached to the floating unit for mooring of the floating unit to a structure, the structure being floating or non-floating.

A non-floating structure is also provided comprising at least one mooring device as described above, wherein the at least one mooring device is attached to the non-floating structure for mooring of a floating unit to the non-floating structure.

The floating unit or the non-floating structure to which the at least one mooring device is attached, may comprise at least one fender device to prevent or cushion impacts against the at least one mooring device.

The at least one fender device is preferably compressible in a direction towards the floating unit or the non-floating structure.

The at least one fender device, in an uncompressed state, preferably extends further out from the floating unit or the non-floating structure than the at least one mooring device when mooring device is fully retracted.

The at least one fender device, in a compressed state, preferably extends substantially equally far out from the floating unit or the non-floating structure as the at least one mooring device when mooring device is fully retracted.

The floating unit or the non-floating structure may comprise one or a plurality of mooring devices and at least one fender device mounted to the floating unit or the non-floating structure, on either side of the mooring device or mooring devices.

The mooring device may be mounted on a floating unit, centrally along a side of floating unit.

A use of the mooring device as described above would be for mooring of a floating unit to a floating or non-floating structure, wherein the mooring device is attached to the floating unit.

A further use of the mooring device as described above would be for mooring of a floating unit to a floating structure or a non-floating structure, wherein the mooring device is attached to the floating structure or the non-floating structure. This means that instead of mounting the mooring device to the floating unit, the mooring unit is mounted on the floating or non-floating structure that the floating unit is moored to, for example a ship, a pier or any other type of floating or non-floating structure to which a floating unit may be moored.

In the following, some non-limiting embodiments of the present invention will be described in more detail, with reference to the figures where:

Figure 7A:
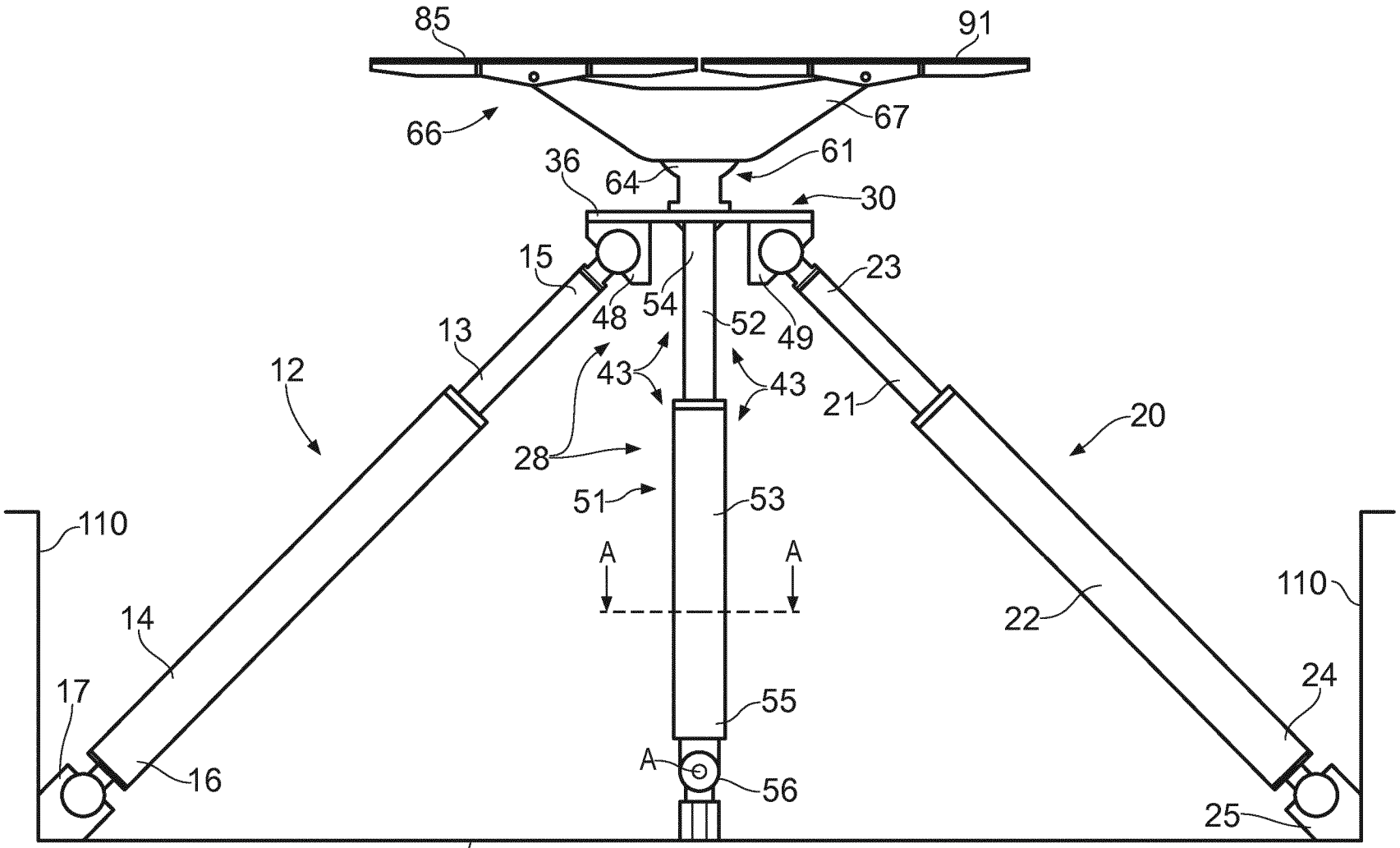

FIG. 7*a* shows a second embodiment of a mooring device according to the present invention.

Figure 7B:
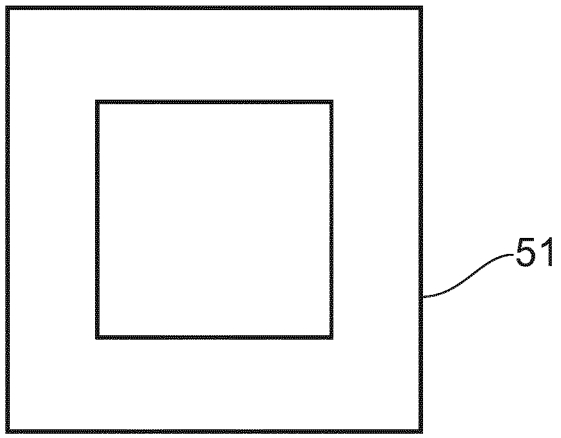

FIG. 7*b* shows the cross-section A-A of the restricting arm of the second embodiment of the present invention as indicated in FIG. 7*a*.

Figure 8:
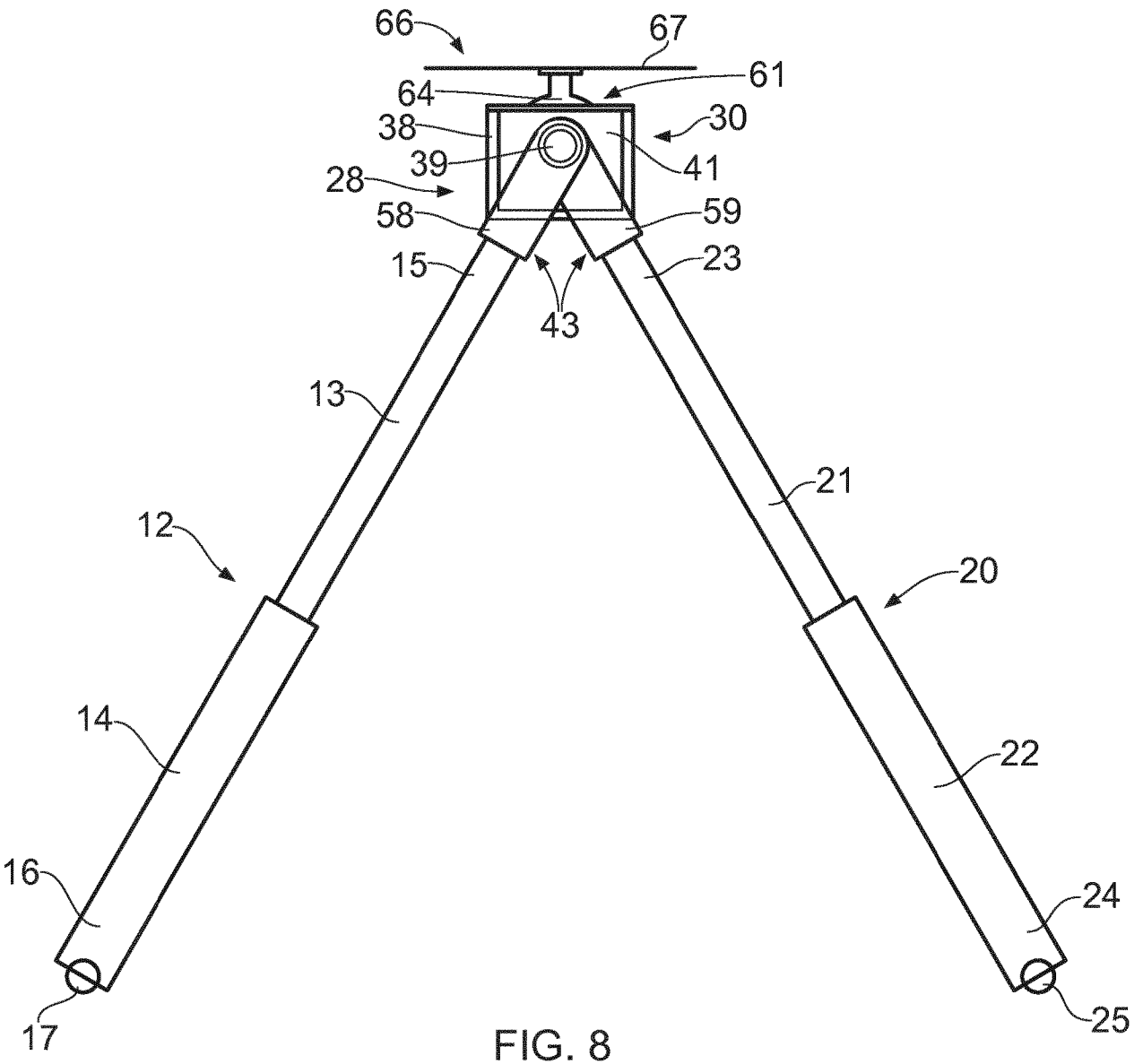

FIG. 8 shows a top view of a third embodiment of a mooring device according to the present invention.

Figure 9:
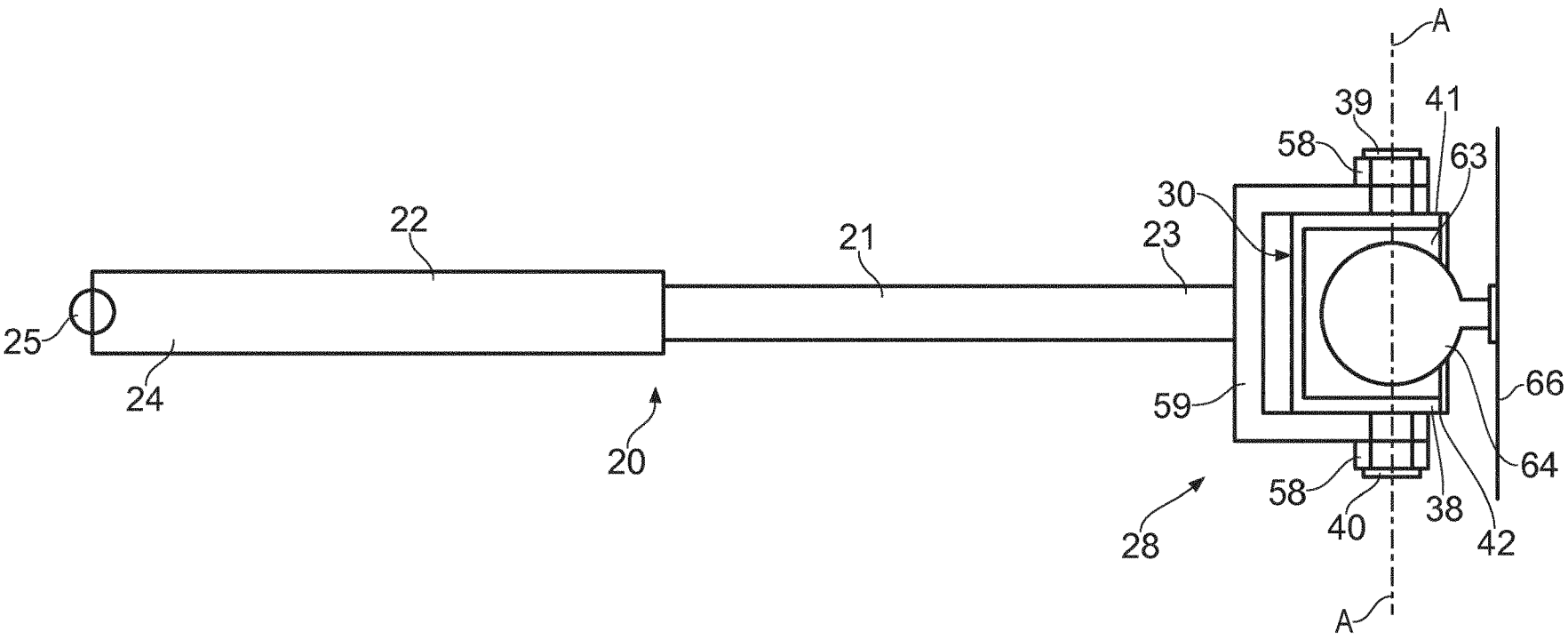

FIG. 9 shows a side view of the third embodiment of a mooring device according to the present invention as shown in FIG. 8.

Figure 10:
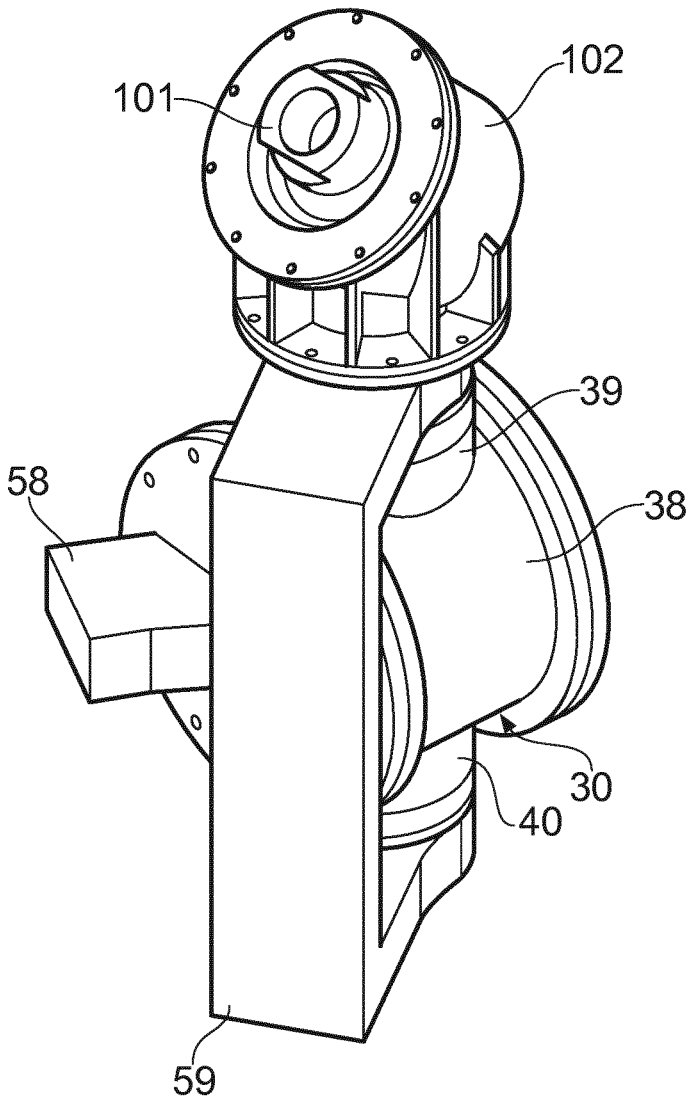

FIG. 10 shows a variant of the support element of the third embodiment of a mooring device according to the present invention as shown in FIGS. 8 and 9.

Figure 11:
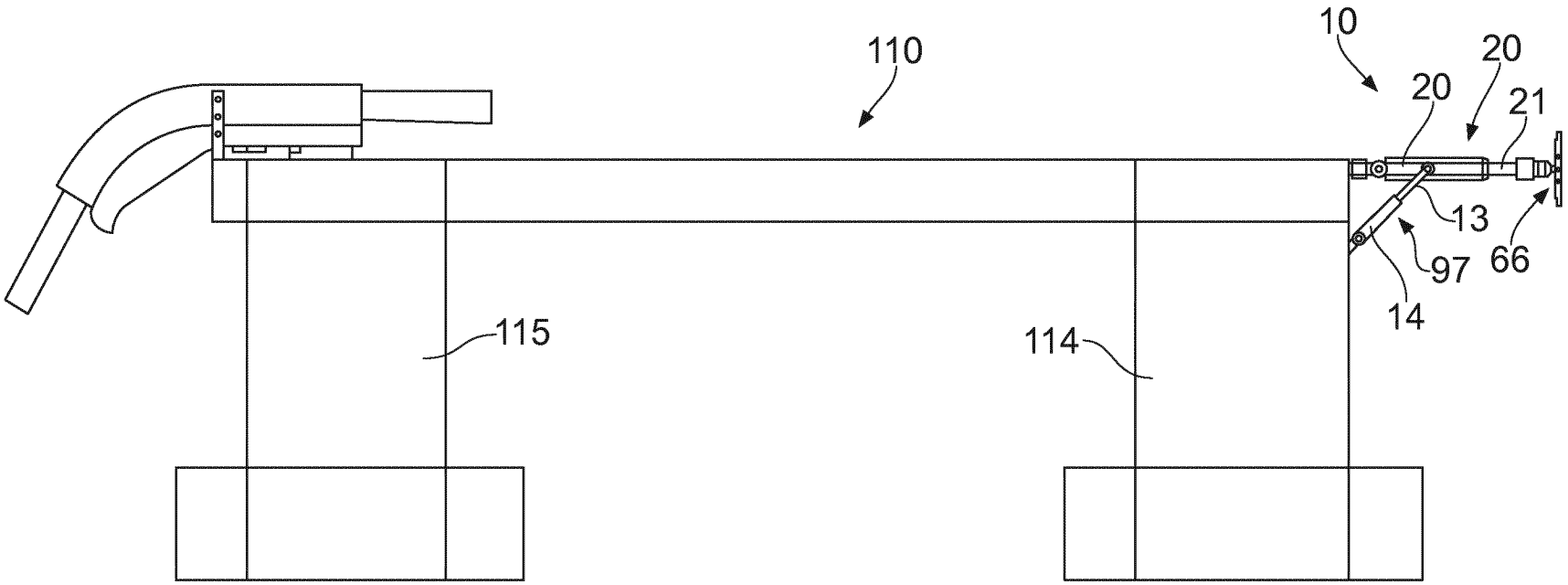

FIG. 11 shows a side view of a floating unit including a mooring device according to the present invention where the support arm is mounted below the first and second mooring arms.

Figure 12:
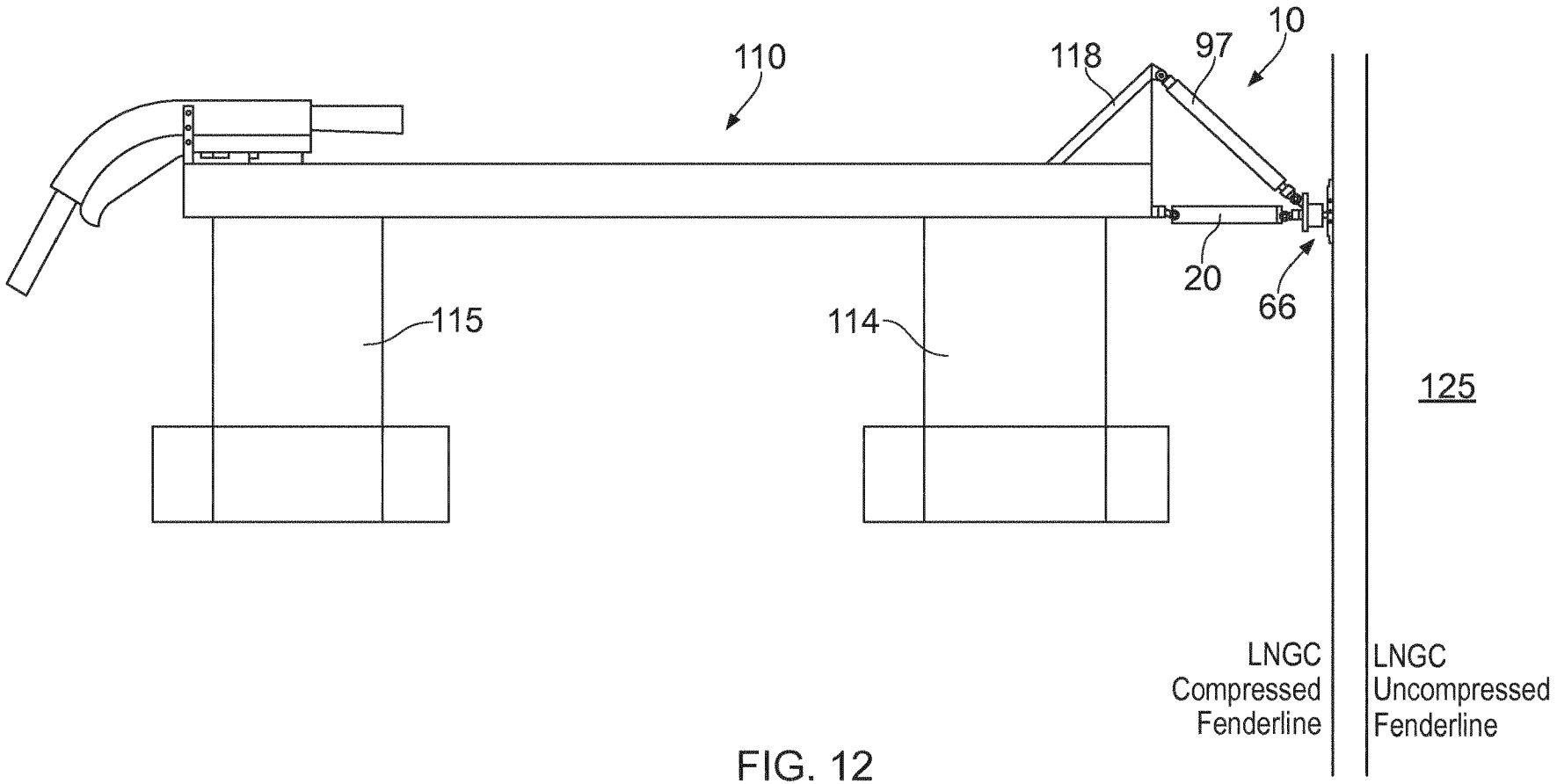

FIG. 12 shows a side view of a floating unit including a mooring device according to the present invention where the support arm is mounted above the first and second mooring arms.

Figure 13:
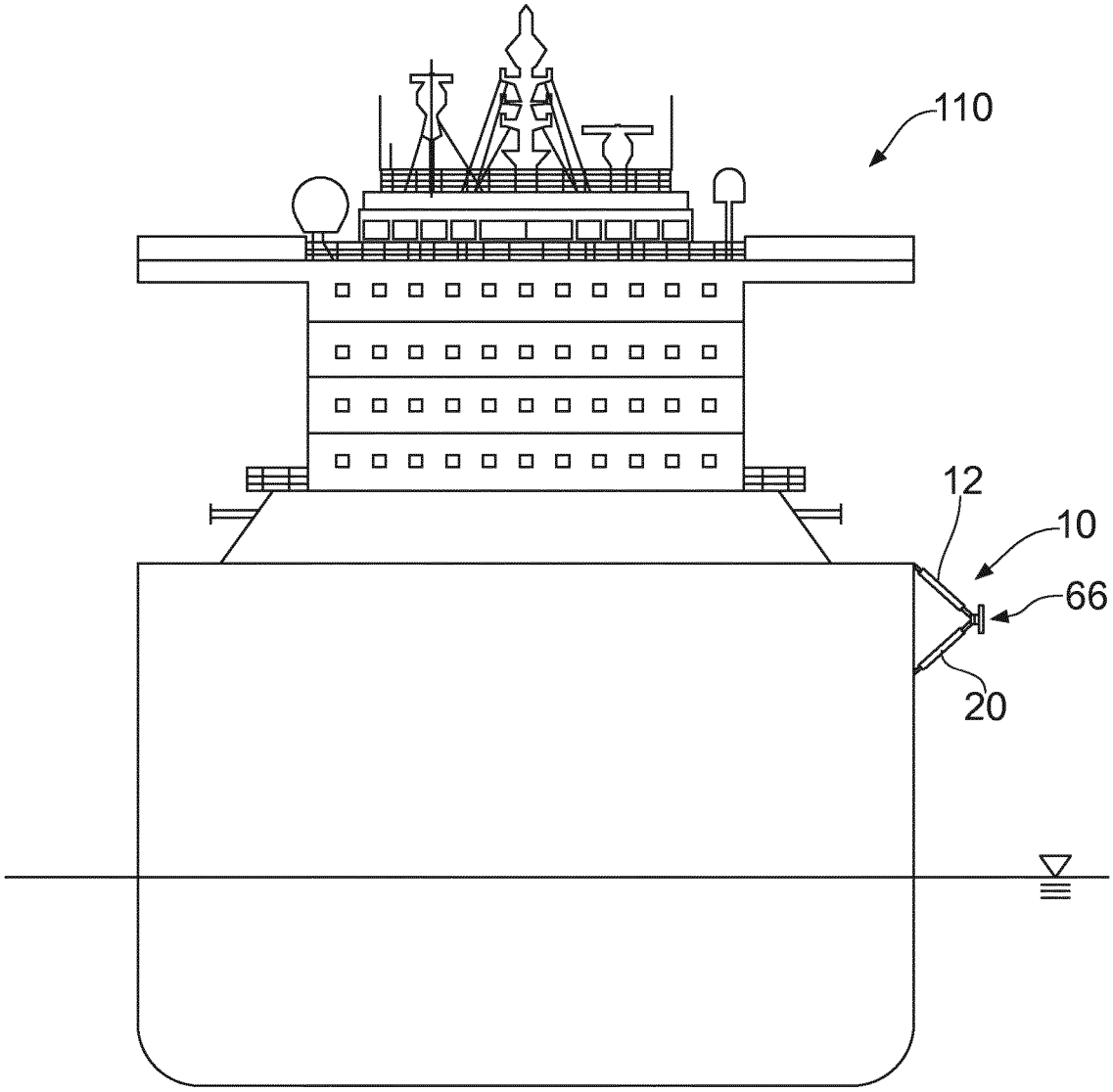

FIG. 13 shows a ship including a mooring device according to the present invention.

Figure 14:
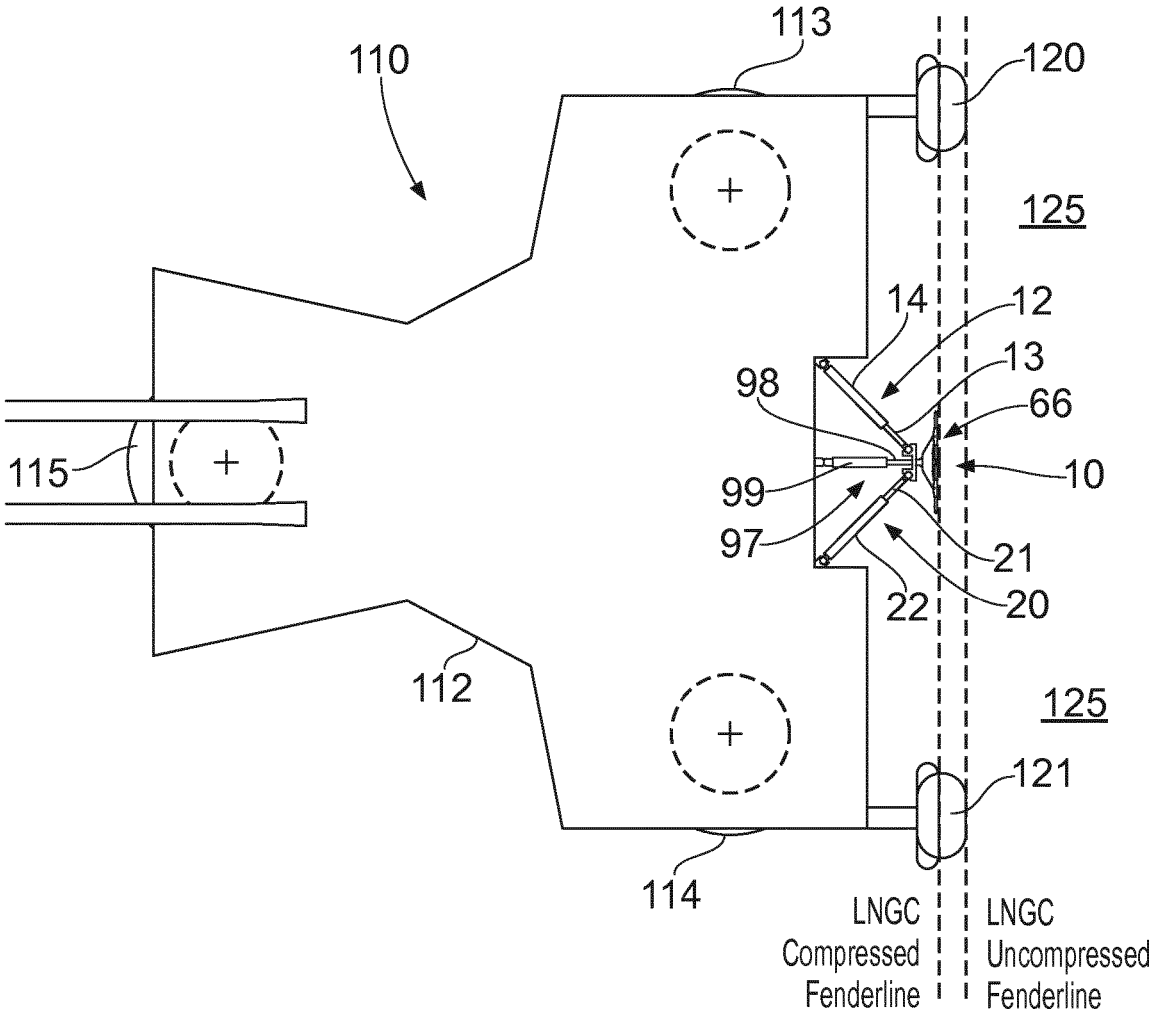

FIG. 14 shows a top view of a floating unit including a mooring device according to the present invention and two fender devices mounted to the floating unit on either side of the mooring device.

Figure 15:
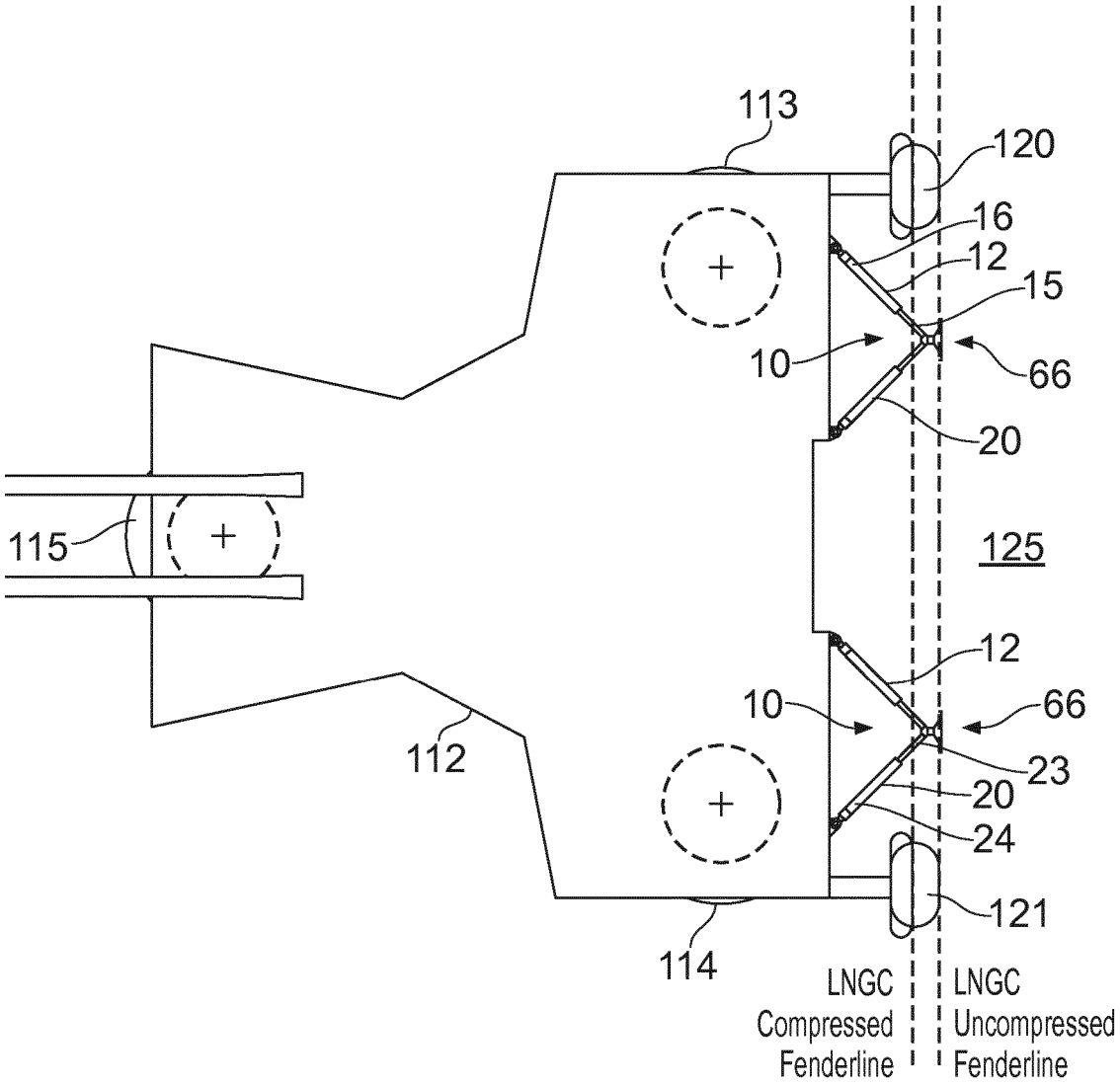

FIG. 15 shows a top view of a floating unit including two mooring devices according to the present invention and two fender devices mounted to the floating unit on either side of the two mooring devices.

Figure 16:
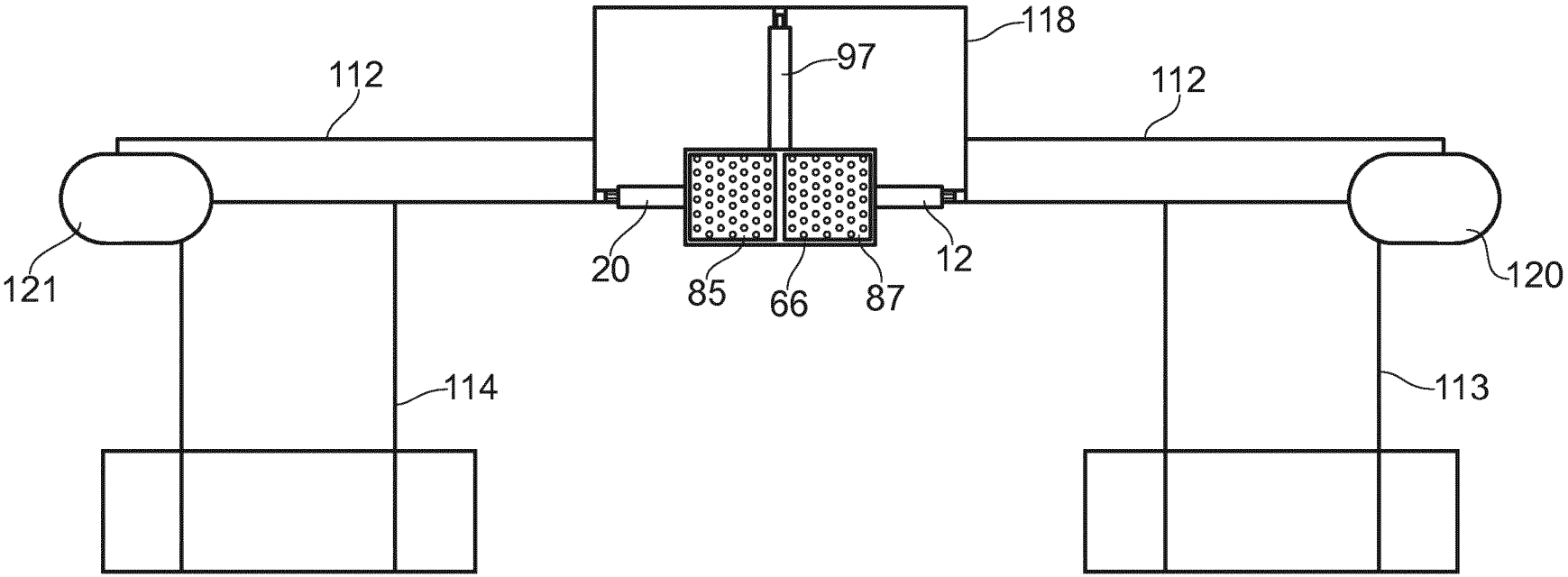

FIG. 16 shows a front view of a floating unit including a mooring device according to the present invention and two fender devices mounted to the floating unit on either side of the mooring device.

Figure 17:
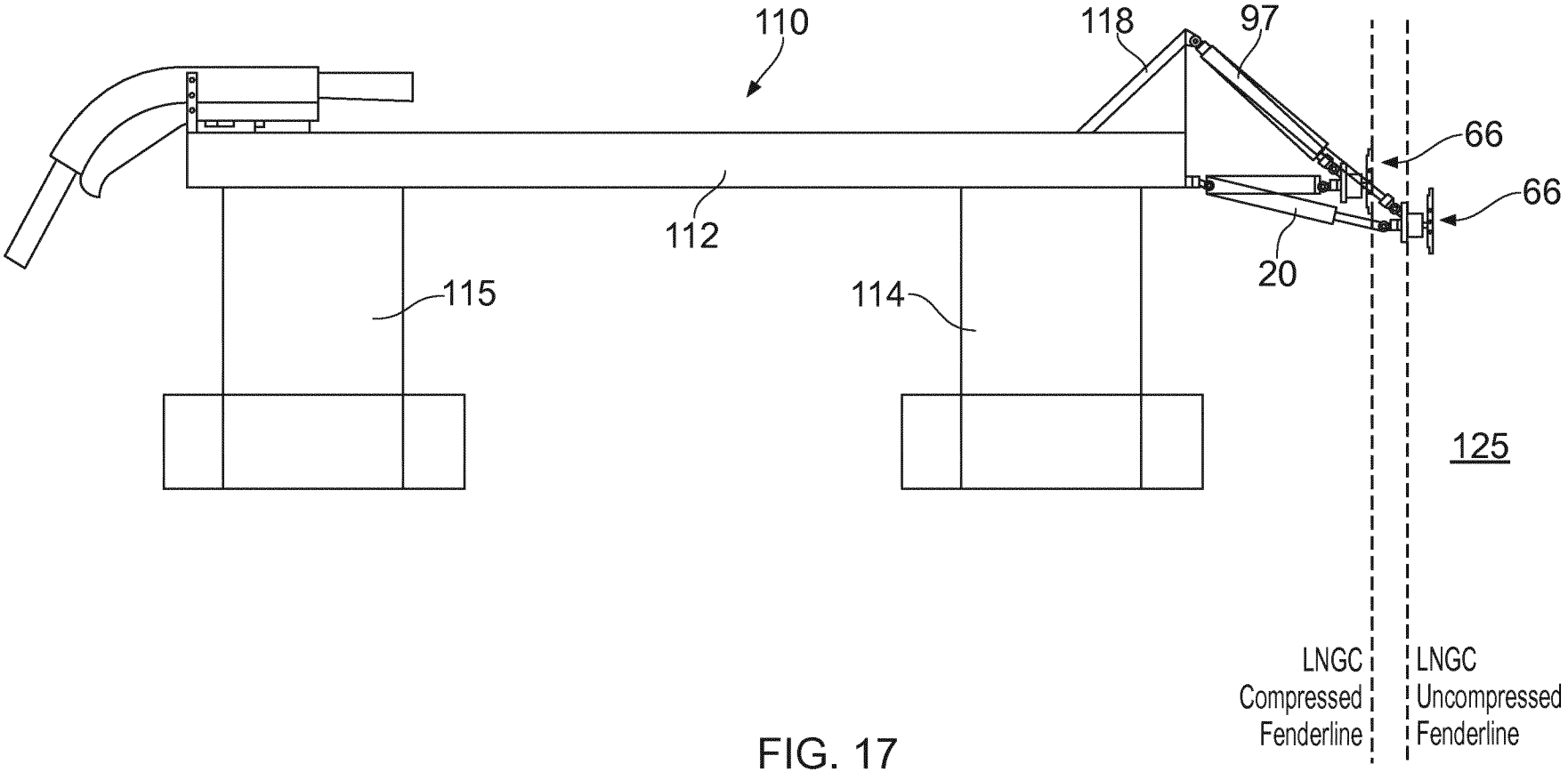

FIG. 17 shows a side view of a floating unit including a mooring device according to the present invention with the attachment unit in two different positions, i.e. positions before and after a movement of the floating unit relative to the floating or non-floating structure to which the floating unit is moored.

Figure 18:
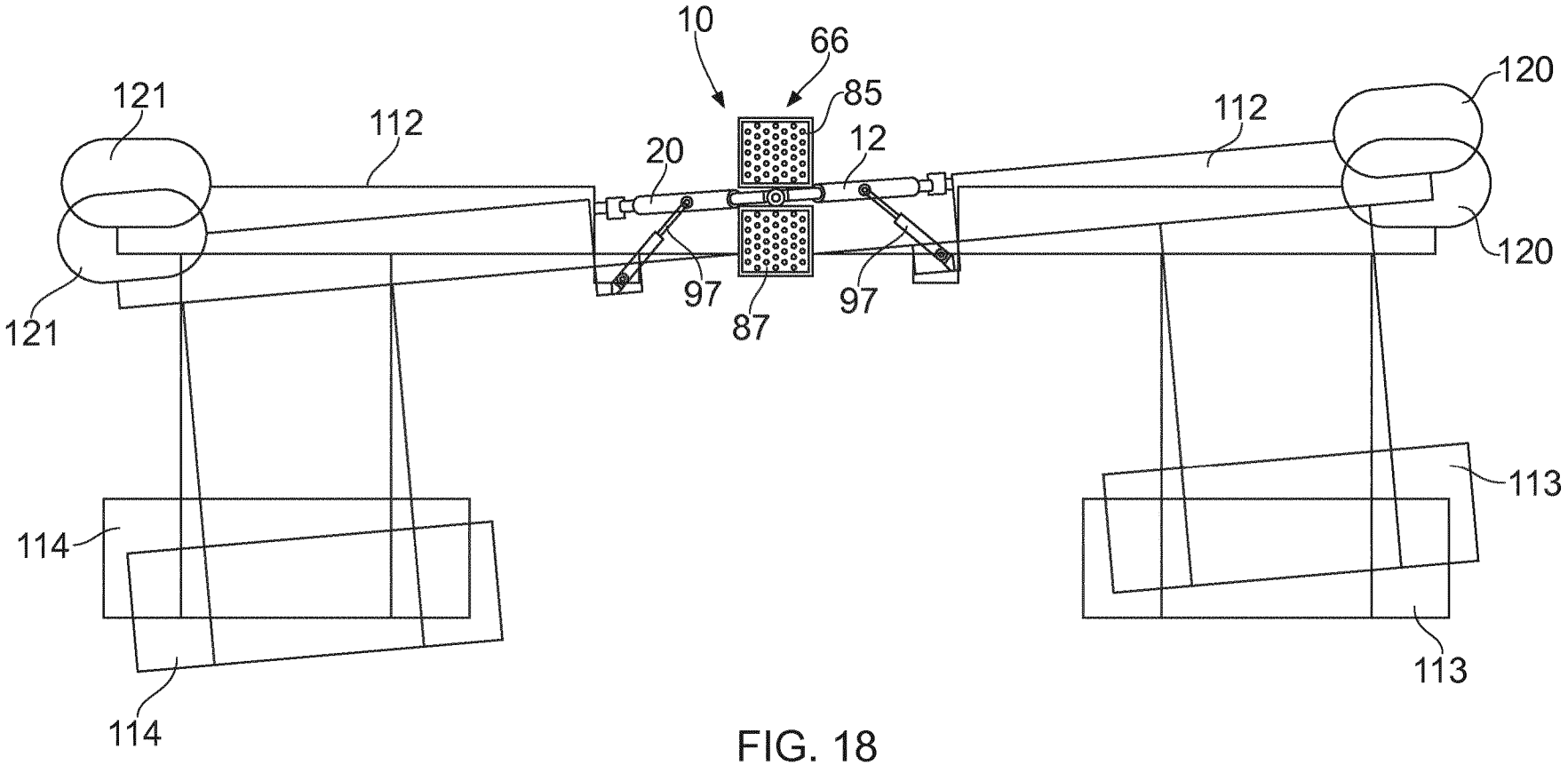

FIG. 18 shows a front view of a floating unit including a mooring device according to the present invention where the attachment unit remain in the same position while the floating unit is shown in two different positions, before and after the floating unit has tilted about a rotational axis that is substantially vertical to the floating or non-floating structure to which the floating unit is moored.

Figure 19:
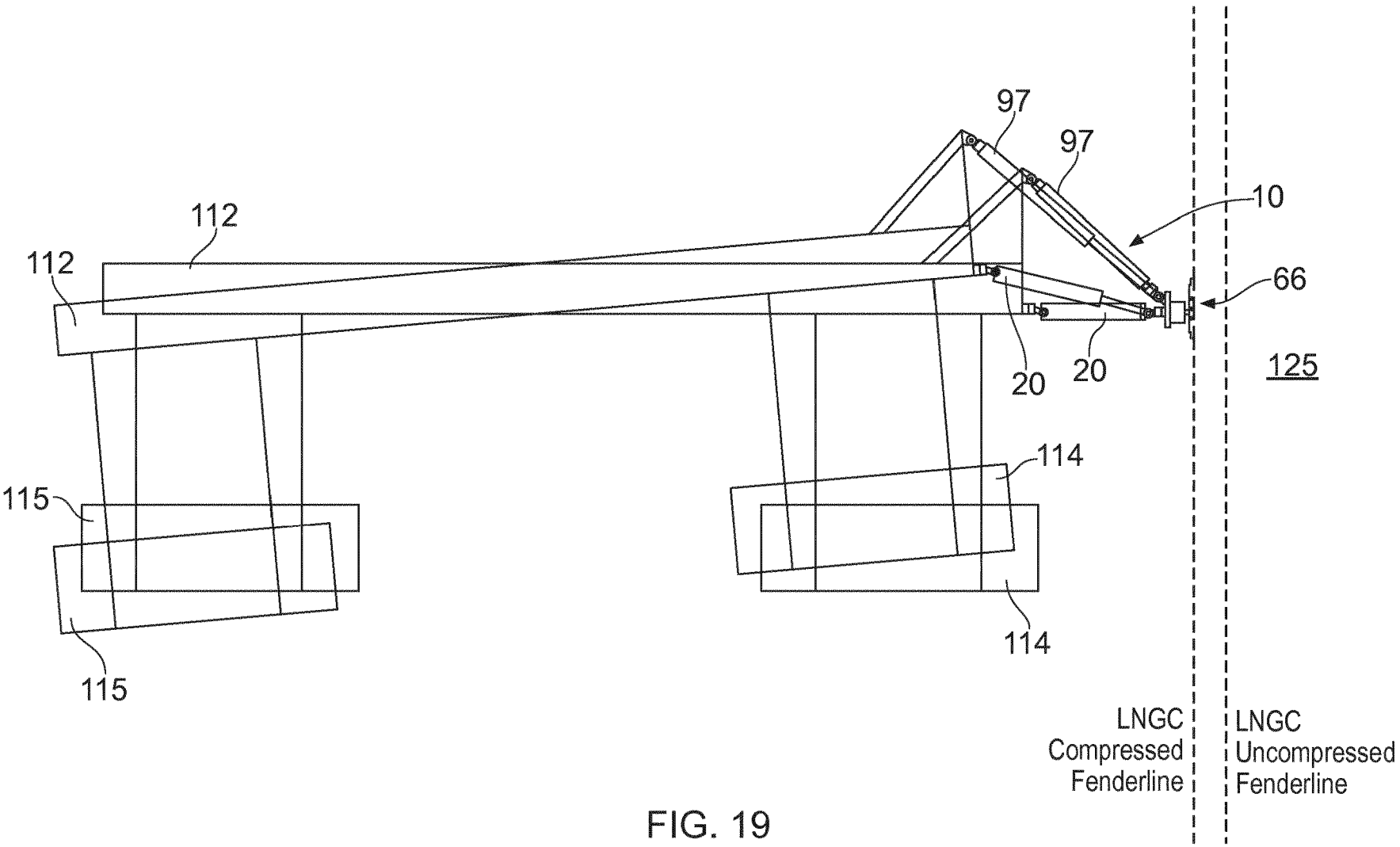

FIG. 19 shows a side view of a floating unit including a mooring device according to the present invention where the attachment unit remain in the same position while the floating unit is shown in two different positions, before and after the floating unit has tilted about a rotational axis that is substantially parallel to the floating or non-floating structure to which the floating unit is moored.

The figures show three different embodiments of a mooring device 10 according to the present invention and two variants of one of the embodiments. The mooring device 10 comprises a joint device 28 that can be designed in different ways, and the three embodiments shown in the figures illustrate three different embodiments of the joint device 28 with two variants of one of the variants. It should be noted that the same features of the different embodiments of the invention shown in the figures have been provided with the same reference numbers.

FIGS. 1-6 show a mooring device 10 according to the present invention. The mooring device 10 comprises a first mooring arm 12 comprising a first end portion 15 and a second end portion 16. The first end portion 15 is attached to a joint device 28, for example with one or more bolts, as indicated in the figures, by welding or any other suitable fastening device or method. The mooring device 10 further comprises a second mooring arm 20 comprising a first end portion 23 and a second end portion 24. The first end portion 23 is attached to the joint device 28, for example with one or more bolts, as indicated in the figures, by welding or any other suitable fastening device or method. The first mooring arm 12 comprises a longitudinal axis passing through the first mooring arm in its longitudinal direction and passing through the first end portion 15 and the second end portion 16. The second mooring arm 20 comprises a longitudinal axis passing through the second mooring arm in its longitudinal direction and passing through the first end portion 23 and the second end portion 24.

To the second end portion 16 of the first mooring arm 12, a first attachment joint device 17 is securely attached, for example with one or more bolt elements, by welding or any other suitable fastening method. The first attachment joint device 17 is adapted to be securely attached to a floating unit 110 or a floating or non-floating structure 125, for example by bolts, welding or any other suitable fastening means or methods for fastening the first attachment joint device 17. The first attachment joint device 17 preferably allows the first mooring arm 12 to rotate about three independent axes relative to a floating unit 110 or the floating or non-floating structure 125 that the mooring device 10 is attached to. For example, the first attachment joint device 17 may be a ball joint or a universal joint but may also be any other joint device that allows movement of the first mooring arm 12 about three independent axes relative to the floating unit 110 or the floating or non-floating structure 125 that the mooring device 10 is attached to.

The first mooring arm 12 is preferably telescopic as is shown in for example FIG. 13, comprising a first telescopic part 13 and a second telescopic part 14 where the first telescopic part 13 is arranged slidingly within the second telescopic part 14 or vice versa. The first mooring arm 12 will typically comprise a piston/cylinder assembly comprising shock absorbing elements, such as one or more springs, and/or one or more damping devices. Such piston/cylinder assemblies are well known in the art and will not be described in further detail here.

As indicated in FIGS. 14 and 15, the first telescopic part 13 of the first mooring arm 12 comprises the first end portion 15 of the first mooring arm 12 as indicated in the figures. Likewise, the second telescopic part 14 of the first mooring arm 12 comprises the second end portion 16 of the first mooring arm 12 as indicated in the figures.

The first attachment joint device 17 is therefore preferably attached to the second telescopic part 14 of the first mooring arm 12 and adapted for attachment to a floating unit 110 or a floating or non-floating structure 125.

To the second end portion 24 of the second mooring device 20, a second attachment joint device 25 is securely attached, for example with one or more bolt elements, with welding or any other suitable fastening method. The second attachment joint device 25 is adapted to be securely attached to a floating unit 110 or a floating or non-floating unit 125, for example by bolts, welding or any other suitable fastening means or methods for fastening the second attachment joint device 25. The second attachment joint device 25 preferably allows the second mooring arm 20 to rotate about three independent axes relative to a floating unit 110 or the floating or non-floating structure 125 that the mooring device 10 is attached to. For example, the second attachment joint device 25 may be a ball joint or a universal joint but may also be any other joint device that allows movement of the second mooring arm 20 about three independent axes relative to the floating unit 110 or the floating or non-floating structure 125 that the mooring device 10 is attached to.

The second mooring arm 20 is preferably telescopic as is shown in for example FIG. 14, comprising a first telescopic part 21 and a second telescopic part 22 where the first telescopic part 21 is arranged slidingly within the second telescopic part 22 or vice versa. The second mooring arm 20 will typically comprise a piston/cylinder assembly comprising shock absorbing elements, such as one or more springs, and/or one or more damping devices. Such piston/cylinder assemblies are well known in the art and will not be described in further detail here.

As shown clearly in FIGS. 14 and 15, the first telescopic part 21 of the second mooring arm 20 comprises the first end portion 23 of the second mooring arm 20 as indicated in the figures. Likewise, the second telescopic part 22 of the second mooring arm 20 comprises the second end portion 24 of the second mooring arm 20 as indicated in the figures.

The second attachment joint device 25 is therefore preferably attached to the second telescopic part 22 of the second mooring arm 20 and adapted for attachment to a floating unit 110 or a floating or non-floating structure 125.

The mooring device 10 further comprises an attachment unit 66 that is attached to the joint device 28 of the mooring device 10.

The attachment unit 66 comprises a frame device 67 and at least one, but preferably a plurality of attachment members 85, 87, 89, 91 that are independently attached to the frame device 67 with respective joint devices that allows the attachment members 85, 87, 89, 91 to rotate about one, two or three independent axes relative to the frame device 67. The joint devices may for example be a bolt element, a cardan joint, a ball joint, a universal joint or any other joint device that will allow the attachment members 85, 87, 89, 91 to move independently about the desired number of independent axes. Vulcanized vacuum pads may also be used which are fairly free to move but is almost completely locked in their positions.

Figure 5:
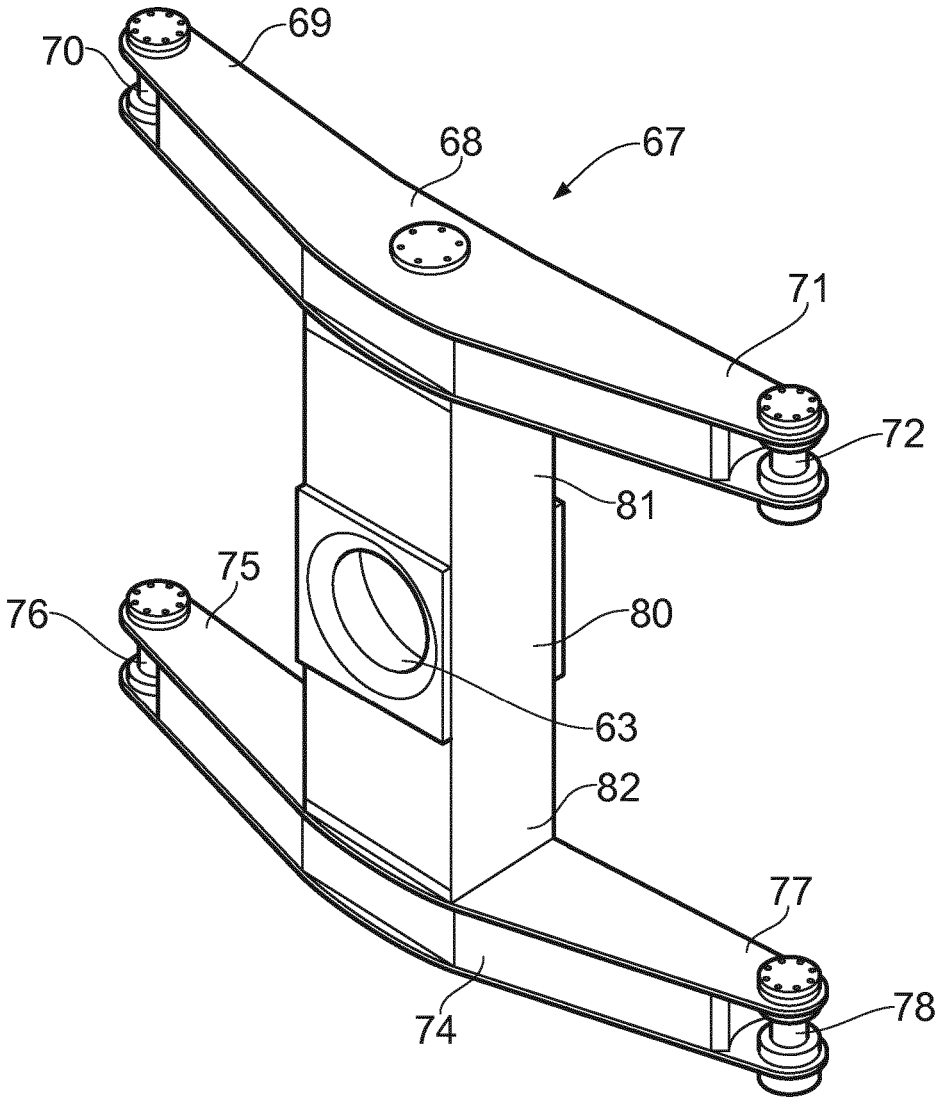
FIG. 5 shows a frame device of the attachment unit of the first embodiment of the present invention shown in FIGS. 1-4.
Figure 6:
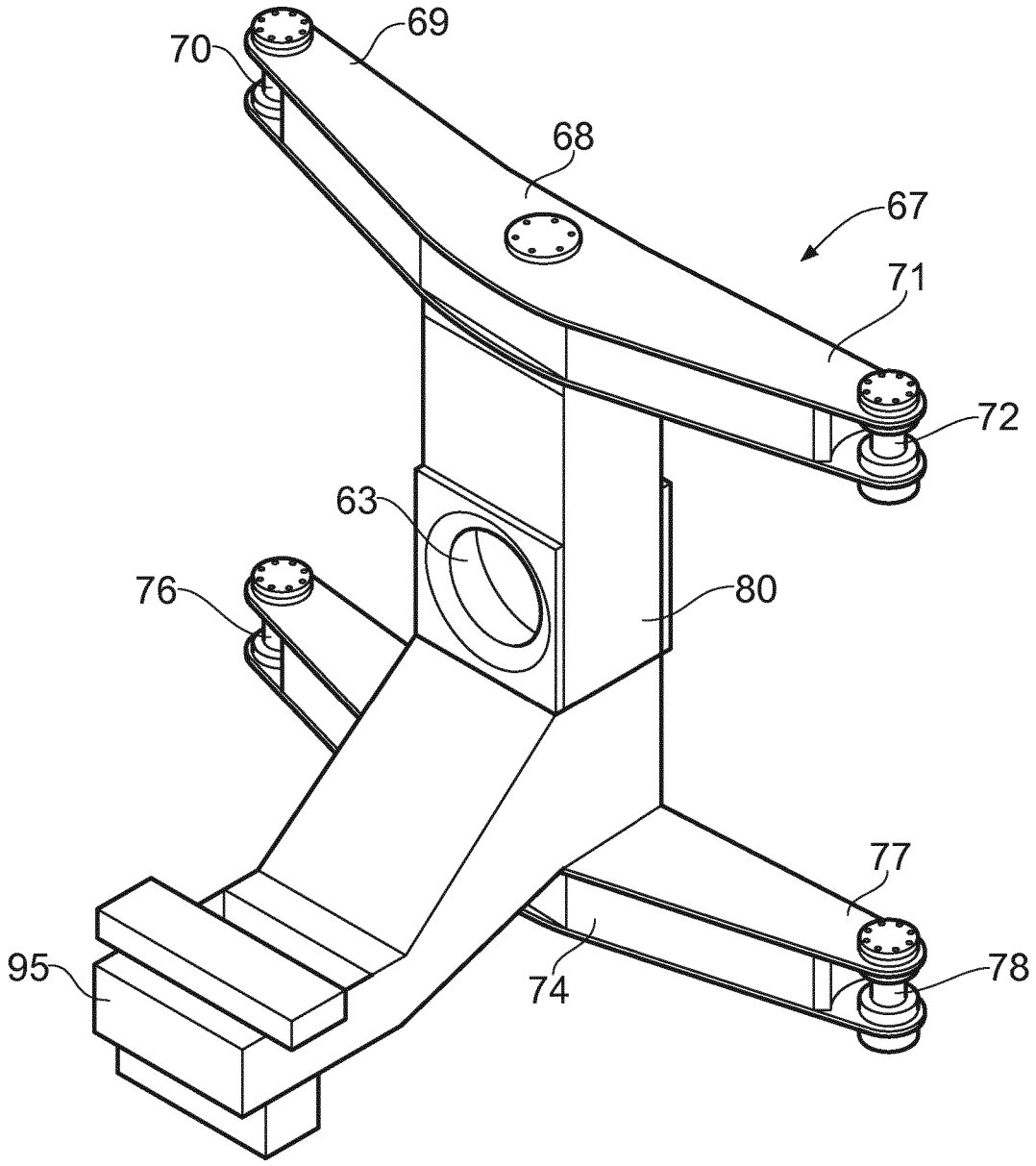
FIG. 6 shows the frame device in FIG. 5 provided with a weight element.

The frame device 67 may obviously be designed in many different ways. One example is shown in FIGS. 1-6 where the frame device 67 comprises a first frame member 68, a second frame member 74 and a third frame member 80. The third frame member 80 is shown in a substantially vertical position in the figures and the first frame member 68 is securely attached to first end portion 81 of the third frame member 80 while the second frame member 74 is securely attached to a second end portion 82 of the third frame member 80 as shown in FIGS. 5 and 6.

The first frame member 68 comprises a first end portion 69 where a first joint device 70 is arranged or mounted. The first attachment member 85 is connected to the first joint device 70 such that the first attachment member 85 is rotatably attached to the frame device 67. The first joint device 70 shown is a bolt element which will allow the first attachment member 85 to rotate about one axis relative to the frame device 67. However, other types of joint devices may also be employed to connect the first attachment member 85 to the first end portion 69 that will allow the first attachment member 85 to rotate about one, two or three axes relative to the first end portion 69 and the frame device 67 as mentioned above.

The first frame member 68 further comprises a second end portion 71 where a second joint device 72 is arranged or mounted. The fourth attachment member 91 is connected to the second joint device 72 such that the fourth attachment member 91 is rotatably attached to the frame device 67. The second joint device 72 shown is a bolt element which will allow the fourth attachment member 91 to rotate about one axis relative to the frame device 67. However, other types of joint devices may also be employed to connect the fourth attachment member 91 to the second end portion 71 that will allow the fourth attachment member 91 to rotate about one, two or three axes relative to the second end portion 71 and the frame device 67 as mentioned above.

The second frame member 74 comprises a first end portion 75 where a third joint device 76 is arranged or mounted. The second attachment member 87 is connected to the third joint device 76 such that the second attachment member 87 is rotatably attached to the frame device 67. The third joint device 76 shown is a bolt element which will allow the second attachment member 87 to rotate about one axis relative to the frame device 67. However, other types of joint devices may also be employed to connect the second attachment member 87 to the first end portion 75 that will allow the second attachment member 87 to rotate about one, two or three axes relative to the first end portion 75 and the frame device 67 as mentioned above.

The second frame member 74 further comprises a second end portion 77 where a fourth joint device 78 is arranged or mounted. The third attachment member 89 is connected to the fourth joint device 78 such that the third attachment member 89 is rotatably attached to the frame device 67. The fourth joint device 78 shown is a bolt element which will allow the third attachment member 89 to rotate about one axis relative to the frame device 67. However, other types of joint devices may also be employed to connect the third attachment member 89 to the second end portion 77 that will allow the third attachment member 89 to rotate about one, two or three axes relative to the second end portion 77 and the frame device 67 as mentioned above.

By choosing other types of joint devices, the attachment members 85, 87, 89, 91 may therefore be made to be rotatable about two or three independent axes relative to the frame device 67 instead of one axis as shown in FIGS. 1-6.

As an alternative to what is mentioned above, the attachment members 85, 87, 89, 91 may be provided with respective spherical joints which are mounted to the bolt elements 70, 72, 76, 78. This arrangement will allow the attachment members 85, 87, 89, 91 to move in three degrees of freedom.

Figure 1:
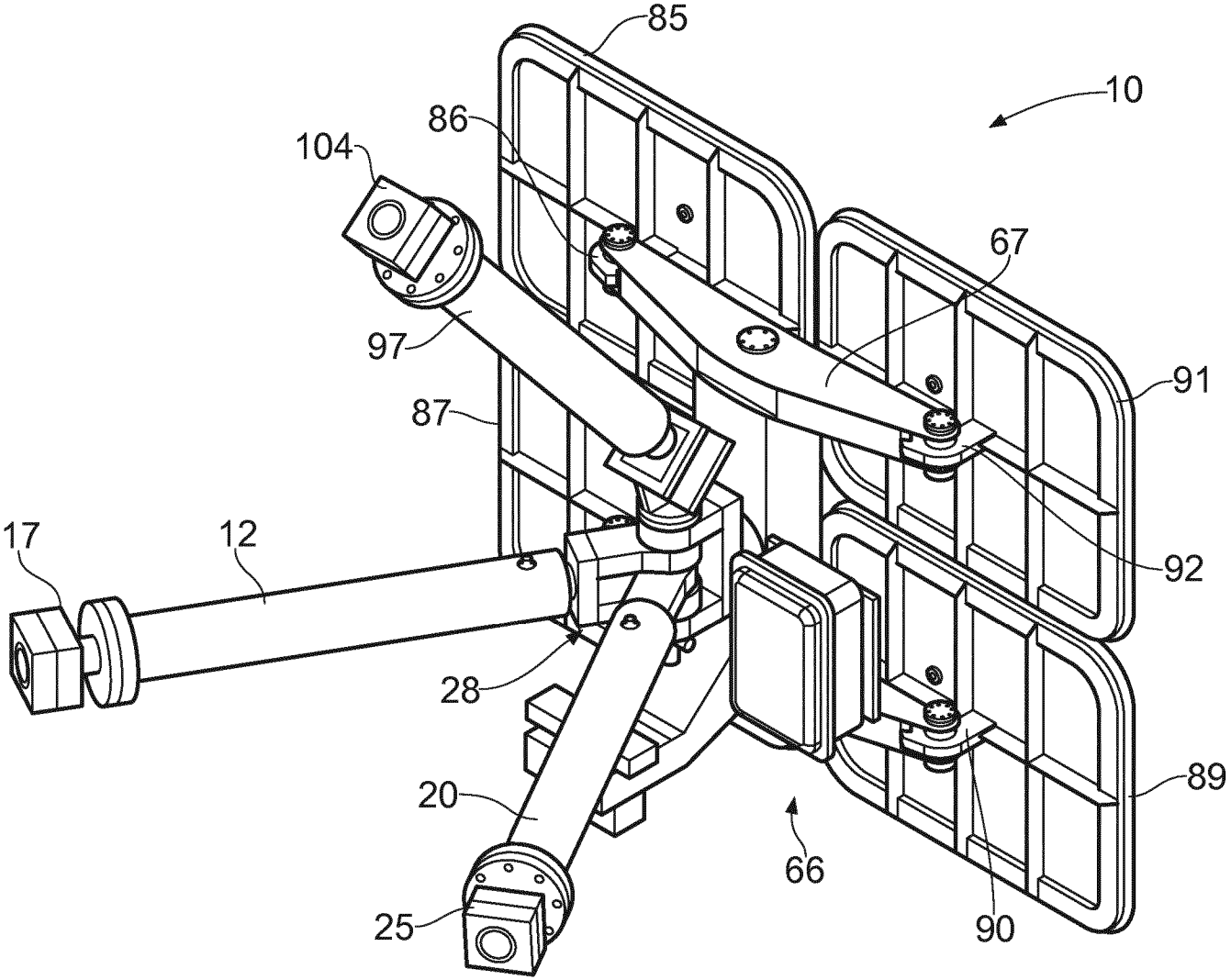
FIG. 1 shows a first embodiment of a mooring device according to the present invention.

As shown in FIG. 1, the attachment unit 66 may be provided with four attachment members, a first attachment member 85 comprising a first attachment element 86 that is rotatably attached to the frame device 67 with a joint device in the form of a bolt element 70, a second attachment member 87 comprising a second attachment element (not visible on FIG. 1) that is rotatably attached to the frame device 67 with a joint device in the form of a bolt element 76, a third attachment member 89 comprising a third attachment element 90 that is rotatably attached to the frame device 67 with a joint device in the form of a bolt element 78 and a forth attachment member 91 comprising a fourth attachment element 92 that is rotatably attached to the frame device 67 with a joint device in the form of a bolt element 72 as further indicated in FIGS. 5 and 6.

It should, however, be mentioned that the attachment unit 66 may be provided with any suitable and desirable number of attachment members other than four as shown in FIG. 1. The attachment unit 66 may for example be provided with two attachment members 85, 87 as indicated in FIGS. 15 and 17, or any other number of attachment members.

As shown in FIG. 6, the attachment unit 66 may comprise a weight element 95. The weight element 95 is shown attached to the third frame member 80 or may form the second end portion 82 of the third frame member 80. The weight element 95 extends in a direction away from the attachment members 85, 87, 89, 91 of the attachment unit 66 and towards the floating unit 110 or floating or non-floating structure 125 on which the mooring device 10 is mounted. The weight element 95 acts as a counter weight and helps to balance the attachment unit 66 and keep it in a desired, substantially vertical position when the attachment unit is not attached to any floating unit or floating or non-floating structure.

The frame device 67 may further comprise, as shown in FIGS. 5-6, a recess for attachment of an attachment unit joint device 61 for attachment of the attachment unit 66 to the joint device 28 mentioned above. The attachment of the attachment unit 66 to the attachment unit joint device 61 varies slightly between the three embodiments of the mooring device 10 shown in the figures and will be further described below.

The first, second, third and fourth attachment members 85, 87, 89, 91 are preferably vacuum pads or electromagnetic pads that can be attached to an outer surface of a floating unit 110 or a floating or non-floating structure 125, for example to the outer surface of the hull of an LNG-carrier, and later be detached from said outer surface. Such vacuum pads and electro-magnetic pads are well known in the art and will not be described in any further detail here.

It should also be mentioned that the attachment unit 66 described above and shown in FIGS. 1-6, may also be included in the second embodiment of the mooring device 10 shown in FIGS. 7*a-b* and the third embodiment of the mooring device 10 shown in FIGS. 8-9.

The mooring device 10 comprises a joint device 28 as mentioned above. The joint device 28 comprises three main parts, a support element 30, an attachment unit joint device 61 that is attached or connected to the support element 30 and a support element joint device 43 that is attached or connected to the support element 30. The joint device 28 is what separates the three embodiments of the mooring device 10 shown in the figures from each other, and the three different designs of the joint device 28 will be described in connection with the description of each embodiment.

The joint device 28 of the first embodiment of the mooring device 10 shown in FIGS. 1-6, comprises a support element 30 that comprises a base plate element 32, a first side plate element 33 that is securely attached to the base plate element 32, for example by welding, and a second side plate element 34 that is securely attached to the base plate element 32, for example by welding. As can be seen from the figures, the support element 30 is preferably generally U-shaped or fork-shaped.

The joint device 28 of the first embodiment of the mooring device 10 further comprises a support element joint device 43 comprising a first mooring arm joint device 44 and a second mooring arm joint device 45.

The first mooring arm joint device 44 is securely attached to the first end portion 15 of the first mooring arm 12, for example by welding or by one or more bolts. The second mooring arm joint device 45 is securely attached to the second mooring arm 20, for example by welding or by one or more bolts.

The first mooring arm joint device 44 may have a generally U-shape or fork-shape as indicated in FIGS. 1-4 and a size so that it fits snugly within the gap of the fork-shaped support element 30. The second mooring arm joint device 45 may be generally plate-shaped and have a size so that it fits snugly within the gap of the fork-shaped first mooring arm joint device 44.

The support element joint device 43 further comprises a bolt element 46 that goes through or passes through corresponding holes in the first side plate element 33 and the second side plate element 34 of the fork-shaped support element 30, the fork-shaped first mooring arm joint device 44 of the support element joint device 43 and the second mooring arm joint device 45 of the support element joint device 43.

This allows a configuration where both the first mooring arm 12 and the second mooring arm 20 are rotatably connected to the support element joint device 43, i.e. the first mooring arm 12 and the second mooring arm 20 are both rotatable about an axis A that passes through the bolt element 46. The axis A is indicated on FIGS. 2 and 4.

However, it may be advantageous if only one of the first mooring arm joint device 44 and the second mooring arm joint device 45 is allowed to rotate relative to the support element 30, since this will allow the movements and the position of the attachment unit 66 to be tracked and controlled.

The first mooring arm joint device 44 may therefore, preferably, be securely attached to the support element 30, for example by welding or by bolting or any other suitable method of securely attaching the first mooring arm joint device 44 to the support element 30. On the other hand, the second mooring arm joint device 45 is preferably rotatably connected to the bolt element 46, i.e. the second mooring arm joint device 45 is rotatable relative to the support element 30 about the axis A passing through the bolt element 46. Alternatively, it would obviously be possible to securely attach the second mooring arm joint device 45 to the support element 30, for example by welding bolting or any other suitable fastening method, while the first mooring arm joint device 44 is connected to the support element rotatable relative to the support element 30 about the axis A passing through the bolt element 46.

This configuration with the plate and fork-shaped first mooring arm joint device 44 and plate-shaped second mooring arm joint device 45 that fits into the fork of the first mooring arm joint device 44, ensures that the one of the first mooring arm joint device 44 and the second mooring arm joint device 45 that is rotatable relative to the support element 30, can only rotate about the axis A passing through the bolt element 46.

Figure 2:
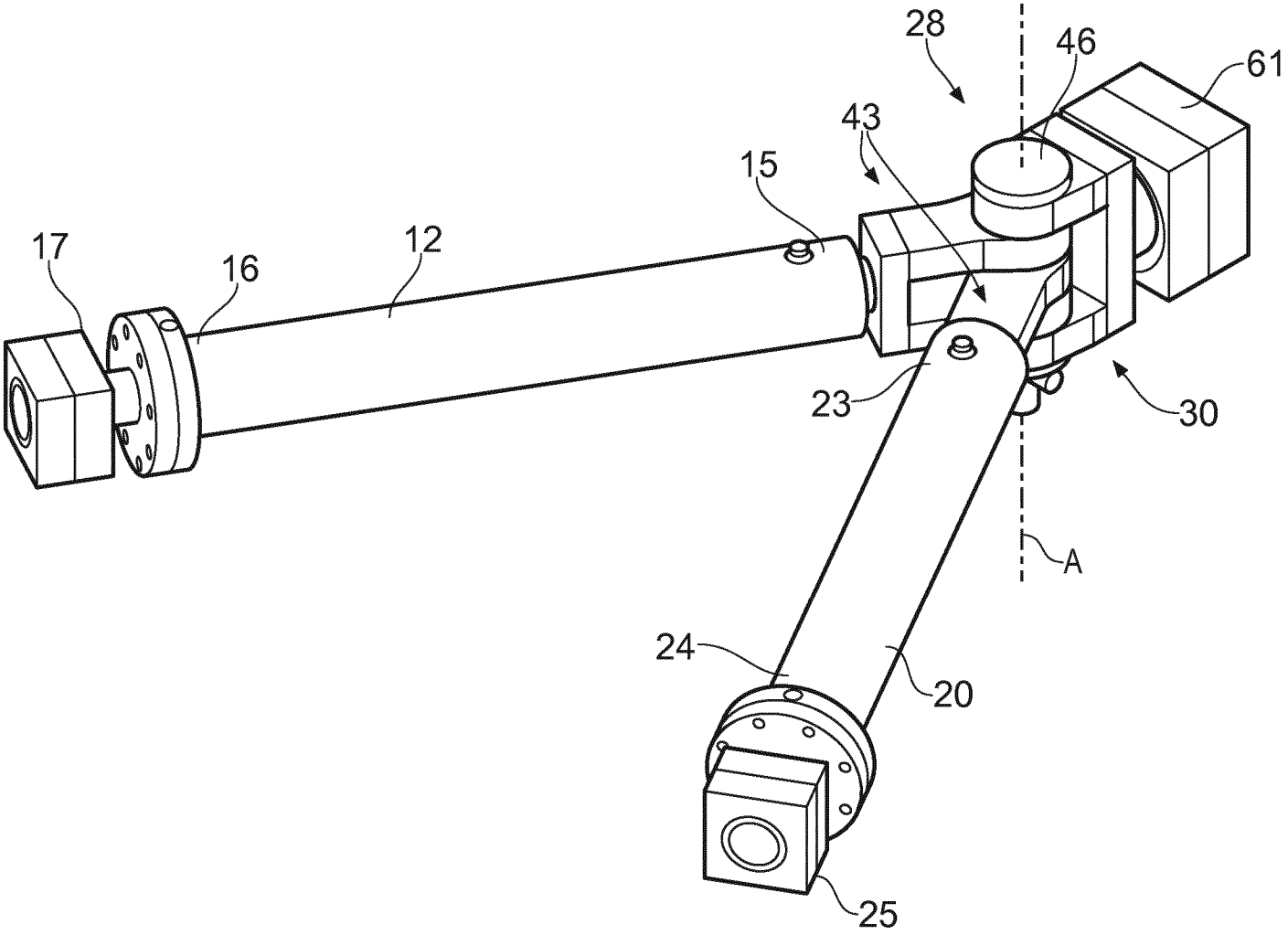
FIG. 2 shows the first mooring arm, the second mooring arm and the joint device of the first embodiment of the present invention shown in FIG. 1.
Figure 4:
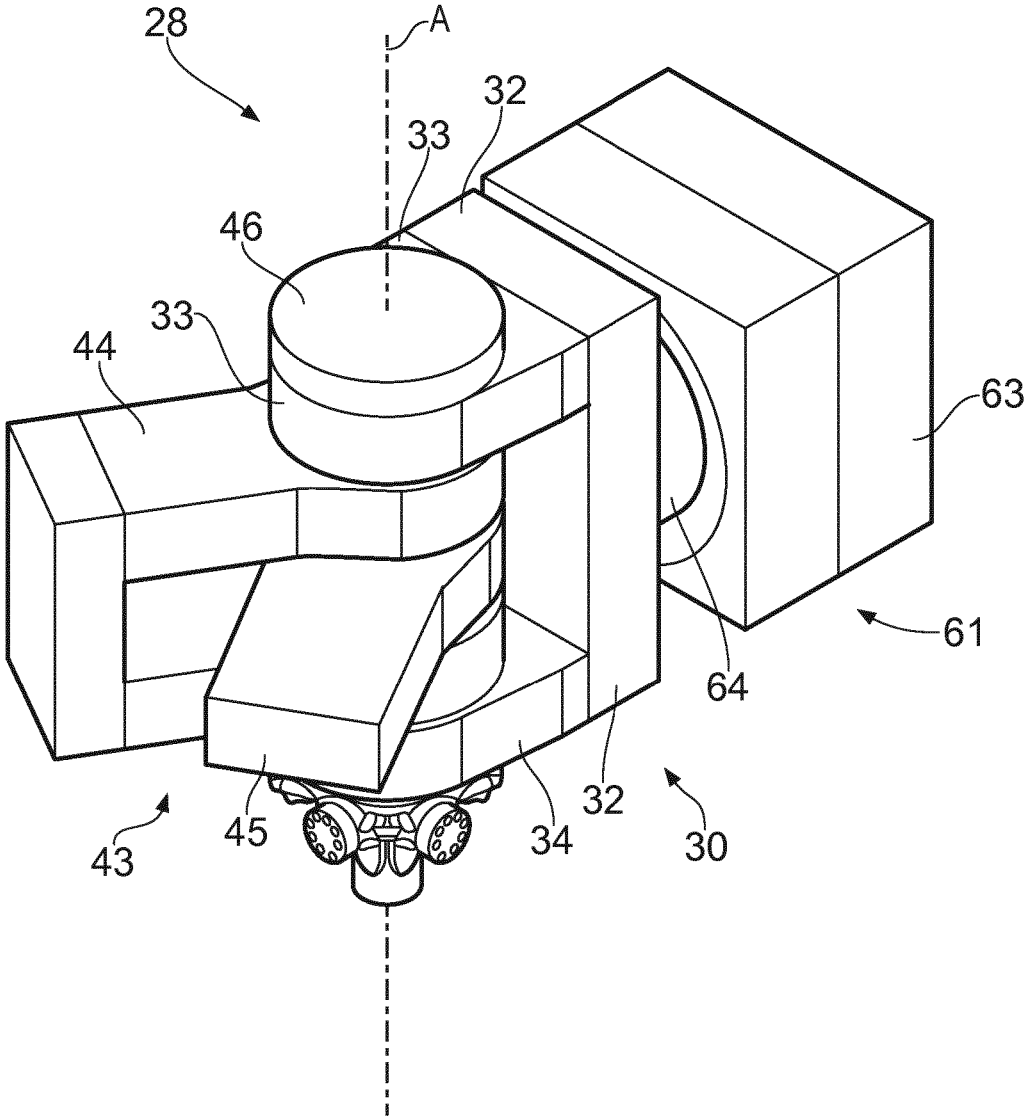
FIG. 4 shows the joint device of the first embodiment of the present invention shown in FIGS. 1-3.

The support element joint device 43 thereby allows the support element 30 to rotate about one axis only which is perpendicular to a plane formed by the longitudinal axis of the first mooring arm and the longitudinal axis of the second mooring arm, where the axis A passes through the bolt element 46 as indicated in FIGS. 2 and 4.

The joint device 28 of the first embodiment of the mooring device 10 further comprises an attachment unit joint device 61 for attachment of the joint device 28 to the attachment unit 66. The attachment unit joint device 61 may be a cardan joint, allowing the attachment unit 66 to rotate about two independent axes relative to the support element 30. Alternatively, as shown in FIGS. 1-6, the attachment unit joint device 61 may be a ball joint which will allow the attachment unit 66 to rotate about three independent axes relative to the support element 30. A ball element 64 may be securely attached to the support element 30 and a ball support element 63 may be mounted in the frame device 67 of the attachment unit 66 (see FIGS. 5 and 6).

The joint device 28 of the second embodiment of the mooring device 10 shown in FIGS. 7*a-b* comprises a support element 30 that comprises a plate element 36.

The joint device 28 of the second embodiment of the mooring device 10 further comprises a support element joint device 43 comprising first mooring arm joint device 48 and a second mooring arm joint device 49. The first mooring arm joint device 48 and the second mooring arm joint device 49 are securely attached to the plate element 36 of the support element 30, for example by welding, by bolting or by any other suitable fastening means.

The first mooring arm joint device 48 preferably allows the first mooring arm 12 to rotate about three different axes of rotation relative to the support element 30. The first mooring arm joint device 48 may for example be a ball joint where the ball element is securely attached to the first end portion 15 of the first mooring arm 12 and the ball support element is securely attached to the plate element 36 of the support element 30 as indicated on FIG. 7*a*.

The second mooring arm joint device 49 preferably allows the second mooring ai n 20 to rotate about three different axes of rotation relative to the support element 30. The second mooring arm joint device 49 may for example be a ball joint where the ball element is securely attached to the first end portion 23 of the second mooring arm 20 and the ball support element is securely attached to the plate element 36 of the support element 30 as indicated in FIG. 7*a*.

The support element joint device 43 further comprises a restricting arm 51, i.e. a movement restricting arm 51 that restricts the movements of the support element 30.

The restricting arm 51 comprises a first end portion 54 and a second end portion 53. The first end portion 54 is securely attached to the support element 30 of the joint device 28, for example by welding, as indicated in FIG. 7*a*, or by bolting or any other suitable fastening means. The second end portion 53 is attached to the floating unit 110 or the floating or non-floating structure 125 with an attachment joint device 56 that allows the restricting arm to rotate about two independent axes relative to the floating unit 110 or the floating or non-floating structure. The restricting arm 51 comprises a longitudinal axis passing through the restricting arm 51 in its longitudinal direction and passing through the first end portion 54 and the second end portion 53.

The restricting arm 51 is preferably telescopic as is shown in FIG. 7*a*, comprising a first telescopic part 52 and a second telescopic part 53 where the first telescopic part 52 is arranged slidingly within the second telescopic part 53 or vice versa. The restricting arm 51 will typically comprise a piston/cylinder assembly and may comprise shock absorbing elements, such as one or more springs, and/or one or more damping devices if that is desired. Such telescoping assemblies and piston/cylinder assemblies are well known in the art and will not be described in further detail here.

The cross-section A-A of the restricting arm 51, as indicated in FIG. 7*a*, is shown in FIG. 7*b*. As shown, the cross section of the restricting arm 51, is made polygonal, for example rectangular or square as shown in FIG. 7*b*, but other polygonal shapes such as hexagonal or triangular, may also be used. The cross section of the first telescopic part 52 and the second telescopic part 53 are both polygonal and of similar size and shape so that the first telescopic part 52 slides easily within the second telescopic part 52. The polygonal shape of the cross section of the restricting arm 51 ensures that there is no twisting movements of the first telescoping part 52 relative to the second telescoping part 53, i.e. there is no rotational movement of support element 30 about the longitudinal axis of the restricting arm 51.

The attachment joint device 56 may be a cardan joint as indicated in FIG. 7*a* which allow the restring arm to rotate about two independent axes relative to the floating unit 110. One axis is the axis A as indicated in FIG. 7*a*, which passes through the attachment joint device 56 and is perpendicular to a plane formed by the longitudinal axis of the first mooring arm 12 and the longitudinal axis of the second mooring arm 20.

This configuration of the joint device 28 of the second embodiment of the mooring device 10, where the restricting arm 51 is securely attached to the plate element of the support element 30 and to the floating unit 110 with a cardan joint 56 and the first mooring arm 12 and the second mooring arm 20 are attached to the support element with ball joints 48 and 49, ensures that the support element joint device 43 allows rotation of the support element 30 about one axis only, i.e. about the axis A which will always be perpendicular to the plane formed by the longitudinal axes of the first mooring arm 12 and the second mooring arm 20.

The support element joint device 43 thereby allows the support element 30, i.e. the plate element 36, to rotate about one axis only, i.e. the axis A indicated in FIG. 7*a*, which is, as mentioned above, perpendicular to a plane formed by the longitudinal axis of the first mooring arm and the longitudinal axis of the second mooring arm.

The joint device 28 of the second embodiment of the mooring device 10 further comprises an attachment unit joint device 61 for attachment of the joint device 28 to the attachment unit 66.

The attachment unit joint device 61 may be a cardan joint, allowing the attachment unit 66 to rotate about two independent axes relative to the support element 30. Alternatively, as shown in FIG. 7*a*, the attachment unit joint device 61 may be a ball joint which will allow the attachment unit 66 to rotate about three independent axes relative to the support element 30, i.e. the plate element 36. A ball element 64 may be securely attached to the support element 30 and a ball support element 63 may be mounted in the frame device 67 of the attachment unit 66 (see FIGS. 5 and 6).

The joint device 28 of the third embodiment of the mooring device 10 shown in FIGS. 8-10, comprises a support element 30 that comprises a holder element 38 with first side face 41 and a second side face 42. A first pin element 39 is securely attached to the first side face and a second pin element 40 is securely attached to the second side face 42. The axis A passes through the first pin element 39 and the second pin element 40 as indicated in FIG. 9.

The holder element 38 comprises a cavity in which the ball support element 63 of the attachment unit joint device may be mounted. As can be seen on FIGS. 8 and 9, the ball element 64 of the attachment unit joint device 61 is in this embodiment securely attached to the attachment unit 66 and the ball element 64 of the ball joint is arranged in the ball support element 63 which is arranged in the holder element 38. This arrangement of the attachment unit joint device 61, when the attachment unit joint device 61 is a ball joint, is advantageous in that it reduces the distance between the attachment unit 66 and the axis A to an extent where the attachment system joint device 61 and the axis A coincides. This passively reduce uncontrolled rotations and/or hinged motion of the attachment unit joint device 61 relative to the axis A.

The joint device 28 of the third embodiment of the mooring device 10 further comprises a support element joint device 43 comprising a first mooring arm joint device 58 that is generally fork-shaped or U-shaped and a second mooring arm joint device 59 that is generally fork-shaped or U-shaped and has a size and shape that makes it fit into the fork-shaped first mooring arm joint device 58.

The first mooring arm joint device 58 is securely attached to the first end portion 15 of the first mooring arm 12 and the second mooring arm joint device 59 is securely attached to the first end portion 23 of the second mooring arm 20.

The first mooring arm joint device 58 and the second mooring arm joint device 59 may be rotatably connected to the first pin element 39 and the second pin element 40 of the support element 30 allowing the support element 30 to rotate relative to both the first mooring arm 12 and the second mooring arm 20.

However, it is preferable that the first mooring arm joint device 58 is securely attached to the support element 30, for example to the first pin element 39 and/or the second pin element 40, and that the second mooring arm joint device 59 is rotatably connected to the support element 30, i.e. to the first pin element 39 and the second pin element 40. Alternatively, the second mooring arm joint device 59 is securely attached to the support element 30, for example to the first pin element 39 and/or the second pin element 40, and the first mooring arm joint device 58 is rotatably connected to the support element 30, i.e. to the first pin element 39 and the second pin element 40.

A slightly different variant of the third embodiment is shown in FIG. 10. The support element 30 still comprises a holder element 38 which in this embodiment has a cylinder-shape instead of a box-shape as shown in FIGS. 8-9. The ball support element (not shown in FIG. 10) of the attachment unit joint device 61 will be arranged in the holder element 38 in the same way as in FIGS. 8-9.

The first mooring arm joint device 58 of the support element joint device 43 is here shown as an element 58 that is securely attached to the support element 30, for example to the holder element 38, by welding, bolting or any other suitable fastening method. The first end portion 15 of the first mooring arm 12 is securely attached to the element 58 and is thereby securely attached to the support element 30. It would also be possible to leave out the first mooring arm joint device 58 and just weld or bolt the first end portion 15 of the first mooring arm 12 directly to the support element 30. The first mooring arm joint device 58 would then simply be a weld or bolts/boltholes that connects the first end portion 15 to the support element 30.

The second mooring arm joint device 59 is fork-shaped in the same way as shown in FIGS. 8-9 and is rotatably connected to the first and second pin elements 39, 40 of the support element 30 as shown in FIGS. 8-9. As in FIG. 8-9, the axis A passes through the pin elements that the fork-shaped second mooring arm joint device 59 is connected to. It should be noted that the configuration of the first mooring arm joint device 58 and the second mooring arm joint device 59 can be arranged the opposite way, i.e. that the second mooring arm joint device 59 is formed by an element that is securely attached to the support element 30 and the first mooring arm joint device 58 is fork-shaped and rotatably connected to the first pin element 39 and the second pin element 40 about the axis A passing through the pin elements 39, 40.

This configuration of the joint device 28 of the third embodiment of the mooring device 10, including the fork-shaped first mooring arm joint device 58 and fork-shaped second mooring arm joint device 59 as shown in FIGS. 8-9, or a first mooring arm joint device 58 comprising an element 58 that is securely attached to the support element 30 and a fork-shaped second mooring arm joint device 59 that is rotatably connected to the pin elements 39, 40 about the axis A passing through the pin elements 39, 40, ensures that the one of the first mooring arm joint device 58 and the second mooring arm joint device 59 that is rotatable arranged relative to the support element 30, can only rotate about the axis A passing through the first pin element 39 and the second pin element 40.

The support element joint device 43 thereby allows the support element 30 to rotate about one axis only which is perpendicular to a plane formed by the longitudinal axis of the first mooring arm and the longitudinal axis of the second mooring arm, where the axis A passes through the bolt element 46 as indicated in FIG. 9.

It was mentioned above that the joint device 28 of the third embodiment of the mooring device 10 further comprises an attachment unit joint device 61 for attachment of the joint device 28 to the attachment unit 66. The attachment unit joint device 61 may be a cardan joint, allowing the attachment unit 66 to rotate about two independent axes relative to the support element 30. Alternatively, as mentioned above and shown in FIGS. 8-10, the attachment unit joint device 61 may be a ball joint which will allow the attachment unit 66 to rotate about three independent axes relative to the support element 30. A ball element 64 may be securely attached to the attachment unit 66 and a ball support element 63 may be mounted in the holder element 38 of the support element 30 as mentioned above.

Figure 3:
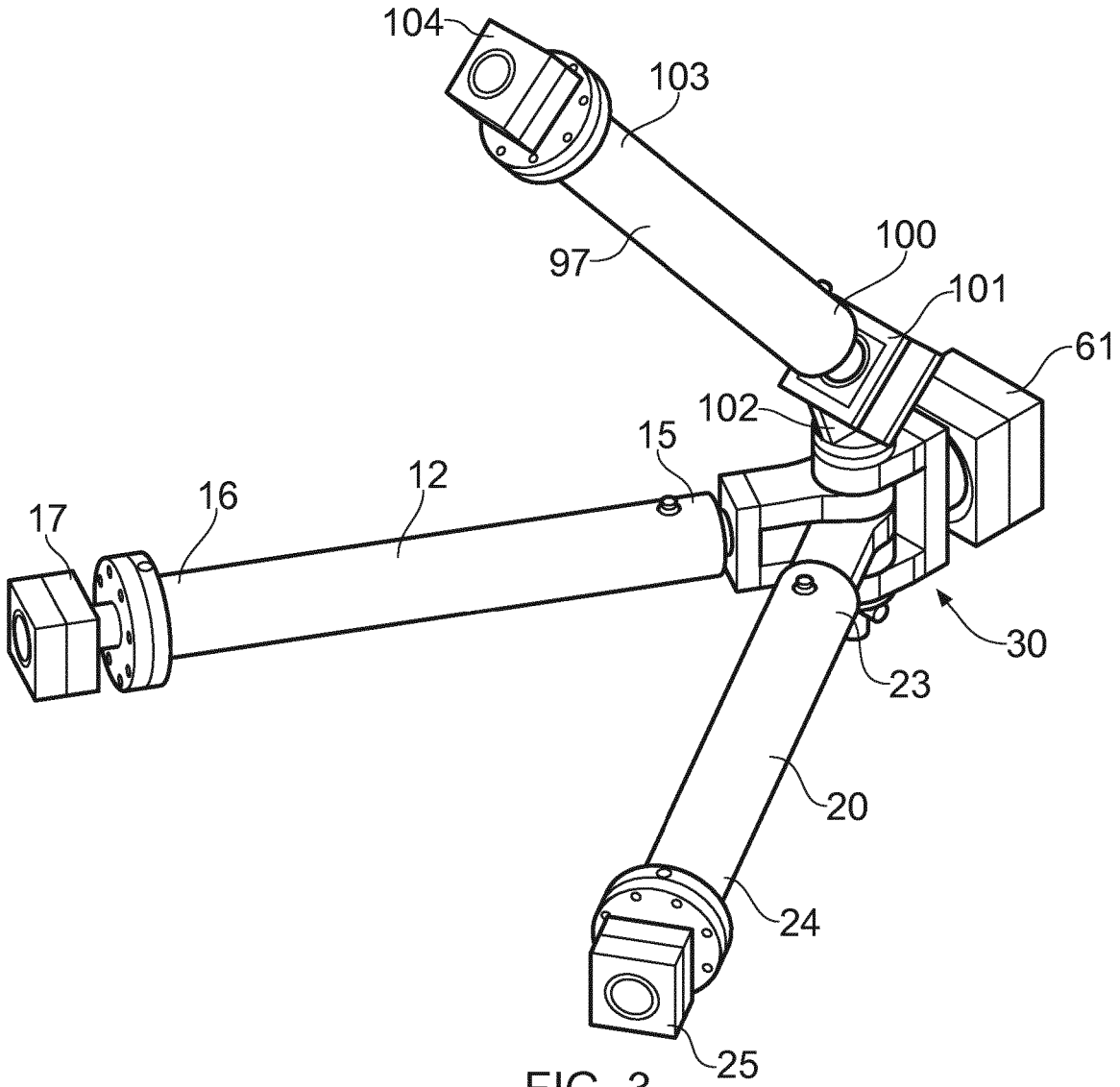
FIG. 3 shows the first mooring arm, the second mooring arm, the support arm and the joint device of the first embodiment of the present invention shown in FIGS. 1 and 2.

The various embodiments of the mooring device 20 preferably further comprises one or more support arms 97 comprising a first end portion 100 and a second end portion 103 as indicated in for example FIG. 3. The first end portion 100 is attached to the joint device 28 and the second end portion is attached to the floating unit 110 or the floating or non-floating structure 125. The support arm 97 comprises a longitudinal axis passing through the support arm 97 in its longitudinal direction and passing through the first end portion 100 and the second end portion 103. The main purpose of the support arm is to support the weight of the mooring device 10.

The support arm 97 is preferably telescopic as is shown in for example FIGS. 11-12 and 14, comprising a first telescopic part 98 and a second telescopic part 99 where the first telescopic part 98 is arranged slidingly within the second telescopic part 99 or vice versa. The support arm 12 will typically comprise a piston/cylinder assembly comprising shock absorbing elements, such as one or more springs, and/or one or more damping devices. Such piston/cylinder assemblies are well known in the art and will not be described in further detail here.

The first telescopic part 98 of the support arm 97 comprises the first end portion 100 of the support arm 97. Likewise, the second telescopic part 99 of the support arm 97 comprises the second end portion 103 of the support arm 20.

A first attachment joint device 101 is preferably attached to the first telescopic part 98 of the support arm 97 and is adapted for attachment of the first attachment joint device 103 to a support element 30 of the joint device 28. The first attachment joint device 101 preferably allows the support arm 97 to rotate about three independent axes relative to the support element 30 and may be a ball joint or a universal joint or any other type of joint that allow the support arm 97 to rotate about three independent axes relative to the support element 30.

A second attachment joint device 104 is preferably attached to the second telescopic part 99 of the support arm 97 and is adapted for attachment of the second attachment joint device 104 to a floating unit 110 or a floating or non-floating structure 125. The second attachment joint device 104 preferably allows the support arm 97 to rotate about three independent axes relative to the floating unit 110 or a floating or non-floating structure 125 to which the mooring arm 10 is attached, and may be a ball joint, a universal joint or any other type of joint that allow the support arm 97 to rotate about three independent axes relative to the floating unit 110 or a floating or non-floating structure 125.

The support arm or support arms 97 may be arranged above the first mooring arm 12 and the second mooring arm 20, as indicated in for example FIGS. 1-6, 10 and 12. Alternatively, the support arm 97 or support arms 97 may be arranged below the first mooring arm 12 and the second mooring arm 20, as indicated in for example FIG. 11. The support arm or support arms 97 are preferably attached to the floating unit 110 or the floating or non-floating structure 125 at the second end portion of the support arms 97 and to the first mooring arm 12, and/or to the second mooring arm 20, and/or to the restring arm 51 and/or the joint device 28 depending on the number of support arms 97 used with the mooring device 10, the weight of the first mooring arm 12, the second mooring arm 20, the restricting arm 51 and the joint device 28 etc. A purpose of the support arm 97 or support arms 97 would be to carry the weight of the attachment unit 66 and to control the position of the attachment unit 66 in space. As mentioned, one or more support arms 97 may be used, which may be connected to both the restricting arm 51 and/or the support element 30 and/or the support element joint device 43.

FIG. 13 illustrates a mooring device 10 mounted on a large ship 110 enabling the ship to be moored to another floating or non-floating structure, or another floating or non-floating structure to be moored to the ship 110. It should be mentioned that any desired number of mooring devices 10 may be mounted on the ship 110.

FIGS. 11-12 and 14-18 illustrates a floating unit 110 with one or two mooring devices 10 mounted on it. Again, it should be understood that any desired number of mooring devices 10 could be mounted to the floating unit 110.

The configuration of the mooring device 10 described herein will allow the floating unit 110 some freedom to move relative to the floating or non-floating structure 125. The attachment unit 66 of the mooring device 10 will be attached to the floating or non-floating structure 125 when the floating unit 110 is moored to the floating or non-floating unit 125. In FIGS. 17-19 some relative movements between the floating unit 110 and the floating or non-floating structure 125 is shown. During the motion of the floating unit 110 relative to the floating or non-floating structure 125, the attachment elements 85, 87, 89 91 of the attachment unit 66 keep the position of the floating or non-floating structure 125 while the deck portion 112 of the floating unit 110, the first and second support arms 12, 20 and other parts of the floating unit 110 and the mooring device(s) 10 will move relative to the attachment elements 85, 87, 89 91 and the floating or non-floating structure 125.

FIG. 17 illustrates a combined relative vertical motion and horizontal motion between the floating unit 110 and the floating or non-floating structure 125. FIG. 18 illustrates a relative rotational motion between the floating unit 110 and the floating or non-floating structure 125 about a horizontal axis that is substantially perpendicular to the side face of the floating or non-floating structure 125 that the attachment elements 85, 87, 89 91 are attached to. FIG. 19 illustrates a relative rotational motion between the floating unit 110 and the floating or non-floating structure 125 about a horizontal axis that is substantially parallel to the side face of the floating or non-floating structure 125 that the attachment elements 85, 87, 89 91 are attached to.

The floating unit 110 may be provided with at least one, but preferably at least two fender devices 120, 121, a first fender device 120 and a second fender device 121 as indicated in FIGS. 14-19. The first and second fender devices 120, 121 will help to prevent the mooring device 10 or mooring devices 10 from being compressed beyond their capabilities and thereby prevent damaging the mooring devices 10 and to prevent the floating unit 110 from hitting the floating or non-floating structure 125 to which the floating unit 110 is moored.

The first and second fender devices 120, 121 may be flexible to a certain degree as indicated in FIGS. 12, 14, 15, 17 and 19 where a compressed fender line is indicated where the first and second fender devices 120, 121 are subjected to forces from the floating or non-floating structure 125, and a uncompressed fender line is indicated where the first and second fender devices 120, 121 are not affected by external forces acting on them.

The flexibility and compressibility of the first and second fender devices 120, 121 may be obtained by using air pressurized elements that are made of a flexible material such as a rubber material. The fender elements 120, 121 may further be filled with foam or rubber. The pressure of air or the stiffness of the foam or rubber inside the fender elements 120, 121 may be adjusted so that a desired compressibility of the first and second fender devices 120, 121 is obtained. As shown in the figures, the floating unit 110 may be provided with one or two mooring devices 10 arranged between the first fender device 120 and the second fender device 121. However, any number of mooring devices 10 may mounted on the floating unit 110 and any number of fender devices 120, 121 may be mounted on the floating unit 110. The arrangement and the relative and mutual positions of the individual fender devices 120, 121 and the mooring device 10 or mooring devices 10 may also vary from one floating unit 110 to another floating unit 110. The fender devices 120, 121, if located on the outside of the mooring devices 10, will help absorb yaw moments of the floating unit 110. Providing a floating unit 110 with one or more fender devices 120, 121 in addition to one or more mooring devices 10, therefore enhances the usability of the mooring devices 10 since external loads acting on the floating unit 110 can at least partly be handled by the one or more fender devices 120, 121, thus reducing the design requirements for the mooring devices 10.

Finally, it should be mentioned that all the above-mentioned embodiments illustrate the invention. However, without limiting the invention, the skilled artisan in the field will be able to contemplate many alternative embodiments without deviating from the scope of the enclosed claims. In the claims, reference numbers in brackets shall not be construed as limiting.

It should be mentioned that the use of the verb "to comprise" herein and its different forms do not exclude the presence of elements or steps which are not mentioned in the claims. The article "a" before an element do not exclude the presence of several such elements.

The invention claimed is:

1. A mooring device for mooring of a floating unit to a structure, the structure being floating or non-floating, in use the mooring device being adapted to be mounted on the floating unit or the structure, the mooring device comprising:

a first mooring arm for transferring and/or absorbing forces and energy that arises when the floating unit is moored to the structure and the floating unit moves relative to the structure, the first mooring arm having a longitudinal axis, a second mooring arm for transferring and/or absorbing forces and energy that arises when the floating unit is moored to the structure and the floating unit moves relative to the structure, the second mooring arm having a longitudinal axis, a joint device comprising a support element, a support element joint device and an attachment unit joint device, the support element joint device being connected to the support element and the attachment unit joint device being attached to or connected to the support element, an attachment unit that is attached to the attachment unit joint device, the attachment unit joint device allowing rotation of the attachment unit about two or three independent axes of rotation relative to the support element, wherein the support element joint device comprises a first mooring arm joint device connected to or attached to the support element and a second mooring arm joint device connected to or attached to the support element, the first mooring arm comprises a first end portion and a second end portion, the second end portion being adapted for attachment to the floating unit or the structure, and the first end portion being attached to the first mooring arm joint device, the second mooring arm comprises a first end portion and a second end portion, the second end portion being adapted for attachment to the floating unit or the structure, and the first end portion being attached to the second mooring arm joint device, the support element joint device in use allows rotation of the support element about one rotational axis A only, relative to the first mooring arm and/or the second mooring arm in all positions of the rotational axis A, the rotational axis A being perpendicular to a plane that is formed by the longitudinal axis of the first mooring arm and the longitudinal axis of the second mooring arm in all positions of the first mooring arm and the second mooring arm.

2. Mooring device according to claim 1, wherein the first mooring arm is telescopic and comprises first telescopic part comprising the first end portion of the first mooring arm, and a second telescopic part comprising the second end portion of the first mooring arm.

3. Mooring device according to claim 1, wherein the second mooring arm is telescopic and comprises first telescopic part comprising the first end portion of the second mooring arm, and a second telescopic part with the second end portion of the second mooring arm.

4. Mooring device according to claim 1, wherein the first mooring arm joint device of the support element joint device or the second mooring arm joint device of the support element joint device is securely attached to the support element.

5. Mooring device according to claim 1, wherein the support element comprises a base plate element, a first side plate element that is securely attached to the base plate element and a second side plate element that is securely attached to the base plate element, the first mooring arm and/or the second mooring arm being rotatably connected to the first side plate element and the second side plate element.

6. Mooring device according to claim 5, wherein the first mooring arm joint device is fork-shaped, that the second mooring arm joint device is plate-shaped and adapted to fit into the fork-shaped first mooring arm joint device, that the support element is fork-shaped and that the fork-shaped first mooring arm joint device is adapted to fit into the fork-shaped support element, such that a bolt element goes through the first mooring arm joint device, the second mooring arm joint device, the first side plate element and the second side plate element.

7. Mooring device according to claim 1, wherein the second end portion of the first mooring arm is attached to a first attachment joint device that is adapted for attachment to the floating unit or the structure and allows rotation of the first mooring arm about three independent axes relative to the floating unit or the structure.

8. Mooring device according to claim 1, wherein the second end portion of the second mooring arm is attached to a second attachment joint device that is adapted for attachment to the floating unit or the structure and allows rotation of the second mooring arm about three independent axes relative to the floating unit or the structure.

9. Mooring device according to claim 1, wherein the support element comprises a plate element to which the first mooring arm joint device and the second mooring arm joint device are securely attached, the first mooring arm joint device and the second mooring arm joint device allowing rotation of the first mooring arm and the second mooring arm respectively about three independent axes of rotation relative to the floating unit or the structure to which the mooring device is mounted.

10. Mooring device according to claim 9, wherein the support element joint device further comprises a restricting arm comprising a first end portion and a second end portion, the second end portion being adapted for attachment to the floating unit or the structure, and the first end portion being securely attached to the support element.

11. Mooring device according to claim 10, wherein the restricting arm is telescopic and comprises first telescopic part comprising the first end portion of the restricting arm, and a second telescopic part comprising the second end portion of the restricting arm.

12. Mooring device according to claim 10, wherein the second end portion of the restricting arm is attached to an attachment joint device that is adapted for attachment to the floating unit or the structure and allows rotation of the restricting arm about two independent axes relative to the floating unit or the structure.

13. Mooring device according to claim 10, wherein the restricting arm is provided with a polygonally shaped cross-section such that rotation of the support element about a longitudinal axis of the restricting arm is prevented.

14. Mooring device according to claim 1, wherein the support element comprises a holder element, a first pin element that is securely attached to the holder element and a second pin element that is securely attached to the holder element, the first mooring arm and the second mooring arm being rotatably connected to the first pin element and the second pin element respectively about an axis A that passes through the first pin element and the second pin element.

15. Mooring device according to claim 14, wherein the first mooring arm joint device is fork-shaped and adapted to be rotatably connected to the first pin element and the second pin element of the holder element, and that the second mooring arm joint device is fork-shaped and adapted to be rotatably connected to the first pin element and the second pin element of the holder element.

16. Mooring device according to claim 14, wherein the first pin element is attached to a first side face of the holder element and the second pin element is attached to a second side face of the holder element, the first side face and the second side face being opposite exterior sides of the holder element.

17. Mooring device according to claim 1, wherein the mooring device further comprises a support arm comprising a first end portion to which a first attachment joint device is attached that is attached to the support element, and a second end portion to which a second attachment joint device is attached that is adapted for attachment to the floating unit or the structure, the first attachment joint device allowing rotation of the support arm about three independent axes relative to the support element and the second attachment joint device allowing rotation of the support arm about three independent axes relative to the floating unit or the structure.

18. Mooring device according to claim 17, wherein the support arm is telescopic and comprises first telescopic part comprising the first end portion of the support arm and a second telescopic part comprising the second end portion of the support arm.

19. Mooring device according to claim 1, wherein the attachment unit joint device comprises a ball element that is securely attached to the support element and a ball support element that is securely attached to the attachment unit.

20. Mooring device according to claim 1, wherein the attachment unit joint device comprises a ball element that is securely attached to the attachment unit and a ball support element that is securely attached to the support element of the joint device.

21. Mooring device according to claim 1, wherein the attachment unit comprises a frame device to which at least one attachment member is rotatably attached and to which the attachment unit joint device is attached.

22. A floating unit comprising at least one mooring device according to claim 1, wherein the at least one mooring device is attached to the floating unit for mooring of the floating unit to a structure, the structure being floating or non-floating.

23. A non-floating structure comprising at least one mooring device according to claim 1, wherein the at least one mooring device is attached to the non-floating structure for mooring of a floating unit to the non-floating structure.

24. Floating unit according to claim 22 or non-floating structure according to claim 23, wherein the floating unit or the non-floating structure to which the at least one mooring device is attached, comprises at least one fender device to prevent or cushion impacts against the at least one mooring device.

25. Floating unit or non-floating structure according to claim 24, wherein the at least one fender device is compressible in a direction towards the floating unit or the non-floating structure.

26. Floating unit or non-floating structure according to claim 24, wherein the at least one fender device, in an uncompressed state, extends further out from the floating unit or the non-floating structure than the at least one mooring device when the mooring device is fully retracted.

27. Floating unit or non-floating structure according to claim 24, wherein the at least one fender device, in a compressed state, extends substantially equally far out from the floating unit or the non-floating structure as the at least one mooring device when mooring device is fully retracted.

28. Floating unit or non-floating structure according to claim 24, wherein the floating unit or the non-floating structure comprises one or a plurality of mooring devices and at least one fender device mounted to the floating unit or the non-floating structure, on either side of the mooring device or mooring devices.

* * * * *